US009867480B2

(12) United States Patent
Doering et al.

(10) Patent No.: US 9,867,480 B2
(45) Date of Patent: Jan. 16, 2018

(54) INFANT SLEEP POD

(71) Applicant: UWM Research Foundation, Inc., Milwaukee, WI (US)

(72) Inventors: Jennifer J. Doering, Milwaukee, WI (US); Greg Krzecki, Milwaukee, WI (US)

(73) Assignee: UWM Research Foundation, Inc., Milwaukee, WI (US)

( * ) Notice: Subject to any disclaimer, the term of this patent is extended or adjusted under 35 U.S.C. 154(b) by 472 days.

(21) Appl. No.: 14/192,656

(22) Filed: Feb. 27, 2014

(65) Prior Publication Data

US 2014/0173822 A1 Jun. 26, 2014

Related U.S. Application Data

(63) Continuation of application No. 14/060,250, filed on Oct. 22, 2013, now Pat. No. 9,554,659.

(Continued)

(51) Int. Cl.
*A47D 9/00* (2006.01)
*A47D 7/04* (2006.01)

(52) U.S. Cl.
CPC ..... *A47D 9/00* (2013.01); *A47D 7/04* (2013.01)

(58) Field of Classification Search
CPC ..... A61G 2203/36; A61G 2203/42; A61G 11/00; A61G 11/001; A61G 11/002;

(Continued)

(56) References Cited

U.S. PATENT DOCUMENTS 157,141 A 11/1874 Stellmann
183,357 A 10/1876 Woodward (Continued)

FOREIGN PATENT DOCUMENTS

| | | |
|---|---|---|
| DE | 19857192 | 6/2000 |
| WO | 1999004691 | 2/1999 |
| WO | 2012063029 | 8/2012 |

OTHER PUBLICATIONS

Office Action from the U.S. Patent and Trademark Office for U.S. Appl. No. 14/060,250 dated Dec. 31, 2015 (6 pages).

(Continued)

*Primary Examiner* — Eric J Kurilla
(74) *Attorney, Agent, or Firm* — Michael Best & Friedrichl LLP

(57) ABSTRACT

An infant sleep pod providing passive and/or active safety features. The infant sleep pod provides a safe sleeping environment for infants sharing sleep areas with adults. The infant sleep pod provides a firm, flat, separate, portable, and dedicated sleep space for an infant. The infant sleep pod includes a base with a bed and sidewall, and a bridge extending across the bed. The bridge covers a head portion of the bed, while a foot portion of the bed is left open for inserting and removing the infant. The bridge prevents pillows and blankets from covering the bed and infant. The infant sleep pod also includes electronics for monitoring the sleep pod. The electronics include a sensor unit in the bridge and a control unit in communication with the sensor unit. The control unit and sensor unit are operable to detect unsafe conditions and, in response, generate alerts.

22 Claims, 17 Drawing Sheets

Related U.S. Application Data

(60) Provisional application No. 61/716,946, filed on Oct. 22, 2012, provisional application No. 61/823,595, filed on May 15, 2013.

(58) Field of Classification Search
CPC .. A61G 11/003; A61G 11/005; A61G 11/006; A61G 11/007; A61G 11/008; A61G 11/009; A61G 11/004; A61G 2200/14; A01K 41/04; A47D 9/00; A47D 7/04; A47D 9/02; A47D 13/02; A63H 33/006; A63H 5/00; A63H 33/00
See application file for complete search history.

(56) References Cited

U.S. PATENT DOCUMENTS 209,623 A 11/1878 Noble
403,773 A 5/1889 Pahlow
454,191 A 6/1891 Weber
516,065 A 3/1894 Thomas
1,246,476 A 11/1917 Scolardi
1,377,607 A 5/1921 Taylor
1,418,541 A 6/1922 Demlinger
1,453,942 A 5/1923 Mills
1,550,415 A 8/1925 Anderson
1,563,428 A 12/1925 Melton
2,234,515 A 3/1941 Carrel et al.
2,235,293 A 3/1941 Mellon
2,392,948 A 1/1946 Reeves
2,409,083 A 10/1946 Valverde
2,528,749 A 11/1950 Hill
2,551,509 A 5/1951 Smith
2,628,358 A 2/1953 Neils
2,689,672 A 9/1954 Thompson
2,846,699 A 8/1958 Watson
2,979,735 A 4/1961 Helmer
3,316,565 A 5/1967 Knowlton
3,583,765 A 6/1971 Wallis
3,898,427 A 8/1975 Levin et al.
4,717,056 A 1/1988 Carmichael
D295,276 S 4/1988 Brown et al.
4,798,551 A 1/1989 Dumonceaux et al.
5,037,375 A * 8/1991 Gatts ..... A61G 7/065 128/898
5,267,680 A 12/1993 Torok
5,341,530 A 8/1994 Ward
5,386,831 A * 2/1995 Gluck ..... A61B 5/01 600/474
5,453,077 A * 9/1995 Donnelly ..... A61G 11/00 600/22
5,464,381 A 11/1995 Wilson
5,551,109 A * 9/1996 Tingley ..... A47D 13/02 128/870
5,713,090 A 2/1998 Rodgers
5,806,924 A 9/1998 Gonas
5,819,341 A 10/1998 Simantob et al.
5,912,624 A * 6/1999 Howard, II ..... G08B 21/02 340/521
5,914,660 A * 6/1999 Mesibov ..... G08B 21/0446 340/517
6,043,741 A * 3/2000 Whitmarsh ..... A61G 3/06 340/522
6,071,228 A 6/2000 Speraw et al.
6,097,294 A 8/2000 Hilton
6,113,455 A * 9/2000 Whelan ..... A63H 33/006 248/214
6,465,489 B1 10/2002 Aulombard et al.
6,513,164 B1 * 2/2003 Hearns ..... A41B 13/06 2/69.5
6,549,140 B1 4/2003 Koessler
6,550,083 B1 4/2003 LaMantia
6,589,089 B1 7/2003 Glass et al.
6,676,475 B1 1/2004 Henderson et al.
6,765,489 B1 7/2004 Ketelhohn
6,862,757 B2 3/2005 Andriunas et al.
7,086,101 B2 8/2006 Welch et al.
7,183,911 B2 2/2007 Sanoner et al.
7,415,739 B2 8/2008 Tharalson et al.
7,439,866 B2 10/2008 Wallner et al.
7,789,413 B2 9/2010 Hei et al.
7,895,690 B2 * 3/2011 Kovalyak ..... A47D 13/08 5/655
7,953,425 B2 5/2011 Jordan
8,316,482 B1 * 11/2012 Martin, III ..... A47C 29/00 5/655
8,381,333 B2 2/2013 Friedman
8,429,771 B2 4/2013 Long
D711,152 S 8/2014 Doering et al.
8,893,327 B1 11/2014 Muhammad
9,232,866 B1 1/2016 Hix et al.
2002/0143233 A1 * 10/2002 Donnelly ..... A61F 7/00 600/22
2003/0171065 A1 * 9/2003 Greenberg ..... A63H 33/006 446/226
2005/0005362 A1 1/2005 Verbovszky
2005/0094962 A1 * 5/2005 Elias ..... A63H 33/006 385/147
2005/0172411 A1 8/2005 Snedeker
2006/0111821 A1 5/2006 Wallner et al.
2008/0052821 A1 3/2008 Morton
2008/0106421 A1 5/2008 Adams et al.
2008/0229496 A1 9/2008 Wang
2008/0287745 A1 11/2008 Hartmann
2009/0163778 A1 6/2009 Sommerville
2010/0116856 A1 5/2010 Tompros et al.
2010/0125949 A1 * 5/2010 Stebbing ..... A47C 21/044 5/423
2010/0186169 A1 7/2010 Kelly et al.
2012/0083670 A1 4/2012 Rotondo et al.
2012/0246824 A1 10/2012 Friedman
2012/0280044 A1 11/2012 Mullis et al.
2013/0111661 A1 5/2013 Furuland
2014/0275742 A1 * 9/2014 Andrew ..... A61M 21/02 600/28
2015/0045608 A1 * 2/2015 Karp ..... A47D 15/008 600/28
2016/0074260 A1 * 3/2016 Belsinger, Jr. ..... A61B 8/06 600/509

OTHER PUBLICATIONS

Office Action from the U.S. Patent and Trademark Office for U.S. Appl. No. 14/060,250 dated May 11, 2016 (14 pages).
Angelcare, "Angelcare AC1100," website, Oct. 4, 2013 (5 pages) http://angelcarebaby.com/international-baby-monitors/.
Angelcare, "Angelcare AC401 Deluxe," website, Oct. 4, 2013 (3 pages) http://angelcarebaby.com/international-baby-monitors/.
Caregiver Watch LLC, "CareAlert Monitoring System," website, Sep. 27, 2013 (3 pages) http://www.caregiverwatch.com/products/.
Low Blue Lights, "Products for Naturally Maximizing Melatonin—A Powerful Antioxidant," website, Jun. 19, 2013 (2 pages) LowBlueLights.com, https://www.lowbluelights.com/detail.asp?id=86.
The First Years, "Close and Secure Baby Sleeper," website (available as early as Mar. 20, 2012) 4 pages, http://diapers.com/p/the-first-years-close-and-secure-sleeper-320712.
Baby Delight, "Snuggle Nest," website (available as early as Nov. 29, 2012) 2 pages, http://babydelight.com/c/snuggle-nest.
Baby Delight, "Snuggle Nest Surround," website (available as early as Nov. 27, 2012) 2 pages, http://babydelight.com/c/snuggle-nest-surround.

* cited by examiner

INFANT SLEEP POD

RELATED APPLICATIONS

This application claims priority to U.S. Nonprovisional patent application Ser. No. 14/060,250, filed Oct. 22, 2013; U.S. Provisional Patent Application No. 61/716,946, filed Oct. 22, 2012; and to U.S. Provisional Patent Application No. 61/823,595, filed May 15, 2013, the entire contents of all of which are incorporated herein by reference.

BACKGROUND

The present invention relates to infant sleeping structures.

Parents and infants sharing a sleeping area or surface can provide several benefits, such as improved bonding and better sleeping by parents and the infant. Additionally, a mother near her infant can better facilitate breastfeeding. An infant can also have greater stability in body temperature, heart rhythms, and breathing patterns by being close to his or her parent. However, an infant sharing a sleep surface with an adult can provide a dangerous situation for the infant. Sharing a sleep surface with an infant increases the likelihood of a sleeping adult unknowingly impinging on space needed by the infant for adequate bodily functions of ventilation, respiration, human structural integrity, and cardiovascular circulation. Additionally, sharing a sleep environment is associated with increased risk of sudden infant death syndrome (SIDS). An infant sleeping in an adult bed is also at risk of suffocation from being covered by blankets, pillows, etc., and from rolling over face-down onto a soft mattress or bedding. Thus, although sharing sleep surfaces provides some benefits to both an infant and his or her parents, it also presents serious risks to the infant.

SUMMARY

Embodiments of the invention relate to creating an infant sleep environment that minimizes both physical threats to the infant's safety and the barriers between a parent and the infant.

Embodiments of the invention relate to creating a safe sleeping environment for infants with an infant sleep pod, including for infants sharing sleep areas with adults. Additionally, embodiments of the invention relate to providing a safe sleeping environment for infants via an infant sleep pod in other settings, such as in/on cribs, floors, hotel rooms, tents, etc. Embodiments of the invention provide a firm, flat, separate, portable, and dedicated sleep space for an infant. Embodiments of the invention also provide infant monitoring to detect unsafe situations and, in response, generate alerts.

In one embodiment, the invention provides an infant sleep pod including a base, an insertion space, and a bridge. The base includes a bed having a head portion and a foot portion, and a sidewall around a perimeter of the bed to define an infant receiving area. The insertion space is above the foot portion and enables insertion of an infant to the infant receiving area. The bridge is coupled to the base and extends across the head portion to form a protective structure above the head portion. The bridge includes a left side leg, a right side leg, and a top leg, with each leg having an apex end in an apex area above the bed and a connecting end coupled to the base. Each leg extends away from the apex area toward a different portion of the base.

In another embodiment, the invention provides an infant sleep pod including a base, an insertion space, and a bridge. The base includes a bed having a head portion and a foot portion, and a sidewall around a perimeter of the bed to define an infant receiving area. The insertion space is above the foot portion and enables insertion of an infant to the infant receiving area. The bridge is coupled to the base and extends across the head portion to form a protective structure above the head portion. The bridge includes a left wing panel and a right wing panel that each have an apex end in an apex area above the bed and a connecting end coupled to the base. Each wing panel extending away from the apex area toward a different portion of the base.

In another embodiment, the invention provides an infant sleep pod including a base, a bridge, and a control unit. The base includes a sidewall and a bed providing an infant sleep area. The bridge extends across the bed and has a bridge sensor sensing a characteristic of at least one of the infant sleep pod and an infant in the infant sleep area. The control unit is in communication with the sensor and is configured to generate an alert based on an output of the sensor.

In another embodiment, the invention provides a method of monitoring an infant sleep pod having a base including a bed, a bridge extending across the bed and including a bridge sensor, and a control unit in communication with the sensor. The method includes receiving, by the control unit, a signal from the bridge sensor; evaluating the signal by the control unit; and generating an alert, by the control unit, based on the evaluation.

Other aspects of the invention will become apparent by consideration of the detailed description and accompanying drawings.

DETAILED DESCRIPTION

Figure 1:
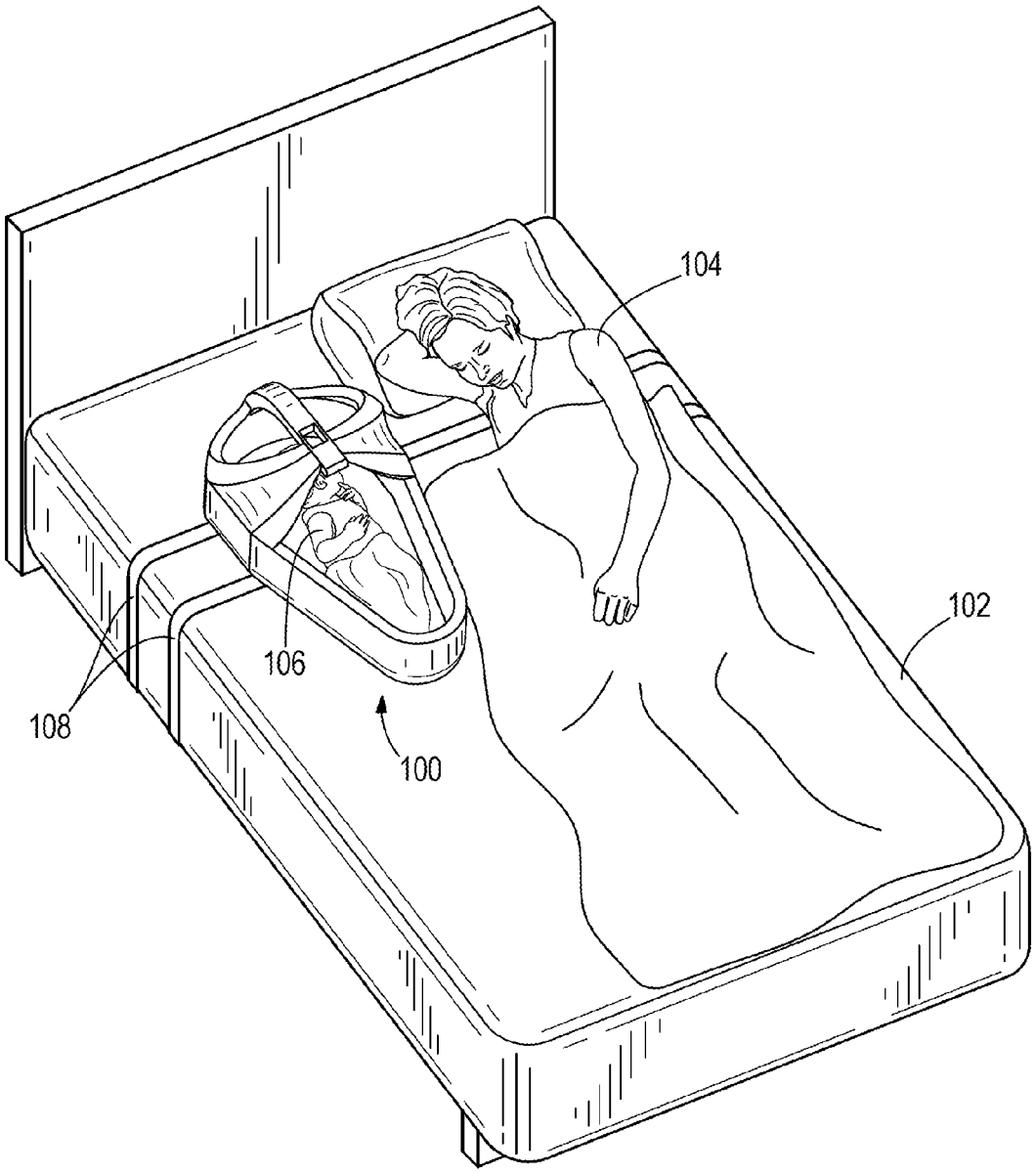
FIG. 1 illustrates a sleep pod according to embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

FIG. 1 illustrates a sleep pod 100 according to embodiments of the invention. The sleep pod 100 is positioned on a bed 102 alongside a sleeping parent 104. An infant 106 is positioned within the sleep pod 100. As described in detail herein, the sleep pod 100 provides a safe sleep environment for the infant 106, which minimizes the risks of injury from blankets, pillows, a parent 104 sharing the bed 102, among other dangers. The sleep pod 100 is secured to the bed 102 via straps 108. For instance, the straps 108 may be threaded through strap through-holes 109 on the underside of the sleep pod 106 (see FIG. 5C). Alternatively or additionally, the straps 108 and sleep pod 100 are fastened to one another via a hook and loop fastener, such as Velcro®. For instance, the straps 108 may include one or both of a hook portion and a loop portion that couples to reciprocal loop and hook portions 110 on the underside of the sleep pod 100 (see FIG. 2B). In some embodiments, the sleep pod 100 is free standing on the bed 102 and not secured via the straps 108. In free standing embodiments, the sleep pod 100 may include tacky or otherwise slip resistant feet on the bottom of the base 111 for resting on a supporting surface, such as the bed 102.

FIGS. 2A-G illustrate an embodiment of the sleep pod 100, sleep pod 100*a*. The sleep pod 100*a* includes a base 111 and a bridge 116. The base 111 includes a bed 112 and a sidewall 114. The bridge 116 has three legs 118, including a left leg 118*a*, a right leg 118*b*, and a center leg 118*c*. The legs 118, which have an arch shape, each have one (connecting) end secured to the base 111 (e.g., the bed 112 or walls 114) through adhesive, fasteners, clamps, etc., and another (apex) end secured to one another at a joining portion 119. The legs 118 may be a single integral unit formed by injection molding using a single bridge mold (not shown). Alternatively, the joining portion 119 of the legs 118 may use adhesive, fasteners, clamps, and/or a mortise and tenon joint arrangement. For instance, the center leg 118*c* may include a mortise that receives tenons of the legs 118*a* and 118*b*, or vice versa, and the joint may be further secured using an adhesive between the mortises and tenons. Additionally, a separate joining device may be provided to attach to and couple together the ends of each of the legs 118 to form the joining portion 119 (see, e.g., FIG. 6B).

The bridge 116 of the sleep pod 100*a* and other embodiments of the sleep pod 100 prevents blankets, pillows, adult limbs, and other foreign objects from obstructing the airway and breathing space of the infant 106 and causing suffocation. Additionally, should the sleep pod 100 overturn, the bridge 116 is rigid enough to hold up the base 111 and to prevent the base 111 from collapsing onto the infant 106.

Figure 3:
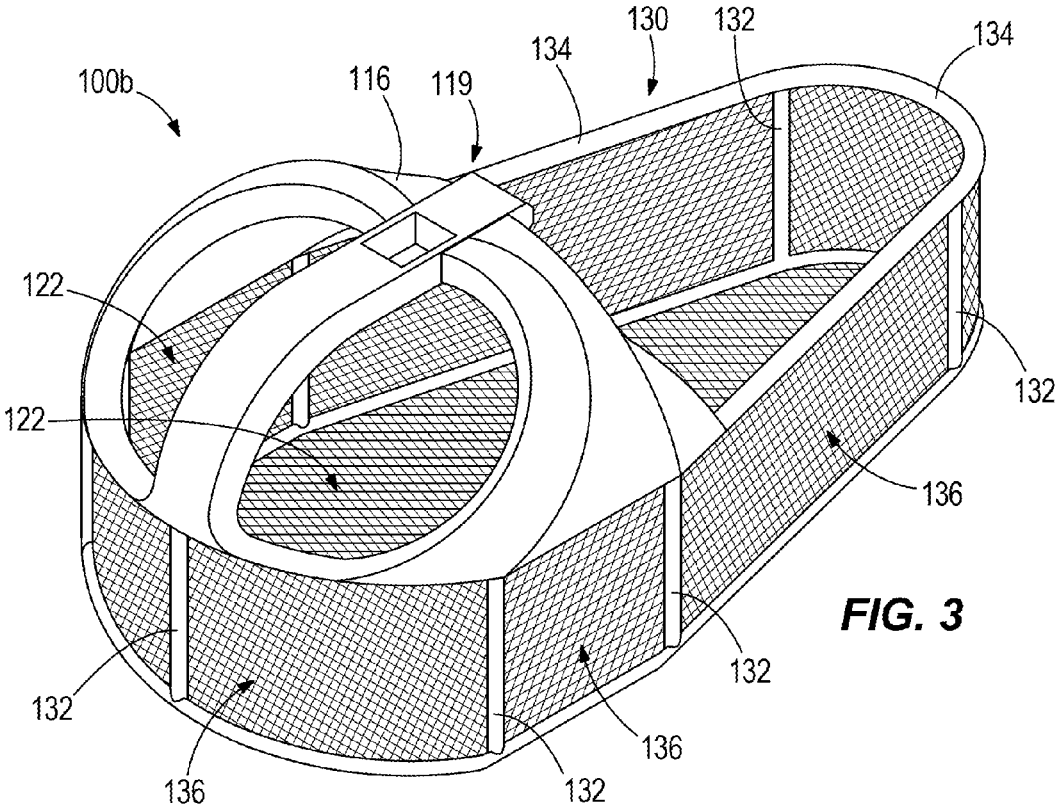
FIG. 3 illustrates another embodiment of the sleep pod.

The sleep pod 100*a* has peek spaces 120, including a first peek space 120*a* and a second peek space 120*b*. The first peek space 120*a* is formed by the left leg 118*a*, center leg 118*c*, and sidewall 114. The second peek space 120*b* is formed by the right leg 118*b*, center leg 118*c*, and sidewall 114. The peek spaces 120 enable a parent 104 to view the infant 106 within the sleep pod 100 from additional angles, some of which may be more common while sleeping next to the infant 106. In some embodiments, mesh liners 122 are secured to the sleep pod 100 across the peek spaces 120 as shown in FIG. 3.

The sidewalls 114 extend upward, away from the bed 112, along the perimeter of the bed 112. A separate, infant sleep area is thus formed by the bed 112, sidewalls 114, and bridge 116. The bed 112 has a head portion 124 and a foot portion 126. The apex ends of the legs 118 terminate in an apex area above the head portion 124 of bed 112 approximately halfway between the left and right sides of sleep pod 100. The head portion 124 is wider than the foot portion 126 to accommodate and mirror the typical dimensions of an infant, which is wider at the torso/shoulders than at the feet. Stated another way, the bed 112 tapers from the head portion 124 to the foot portion 126. The shape of the bed 112 encourages placement of the infant 106 in the appropriate position within the sleep pod 100—with the head of the infant 106 at the head portion 124 under the bridge 116. This placement ensures that the infant 106 receives the fullest protections of the sleep pod 100. The foot portion 126 is generally open and not covered by the bridge 116. Thus, the space above foot portion 126 and frontward of the bridge 116 provides an insertion space for placing and removing the infant 106 in/from the sleep pod 100.

The base 111 is generally wide-enough to resist roll-over of the sleep pod 100. Additionally, the weight distribution of the base 111 is such that the sleep pod 100 provides a generally self-righting capability if tipped to some extent.

In some embodiments of the sleep pod 100, including the sleep pod 100*a*, a mesh liner (not shown) is applied over the entire sleep area to provide a bug netting preventing insects from entering the sleep area. For instance, the mesh liner is secured along the outer perimeter of the base 111 (e.g., along the walls 114) and above the bridge 116, forming a mesh canopy over the bed 112. The bug netting is particularly useful in outdoor settings, such as camping, and in third world countries and tropic areas where insect-borne illnesses, such as malaria, can be more common.

The base 111 and the bridge 116 are constructed of a light-weight foam material. One or more molds (not shown), such as a single sleep pod mold or separate base and bridge molds, may be injected with a liquid mixture that cures to form the light-weight foam material. Different mixtures may be used such that the resulting base 111 and bridge 116 have different densities, causing different flexibility/rigidity levels and weights of the portions. In some embodiments, the bridge 111 is formed to have more flexibility or give than the base 111. Additionally, in some instances, the base 111 includes a stiffener to provide additional rigidity. For instance, the bed 102 may have a generally flat high density polyethylene (HDP) insert that is placed in the mold such that the foam material cures around the insertion to secure it into a non-removable position. The insert (not shown) may have various shapes and sizes, such as a narrow rectangle extending along the length of the base, a cross-shape to provide additional stiffness along both the length and the width, a shape mimicking the surface of the bed 112 having a wider head portion and narrower foot portion, etc. The foam construction of the bridge 116 and base 111 enables temporary deflections, twisting, and other deformations of the sleep pod 100 without permanent damage thereto. That is, the bridge 116 and base 111 generally spring back to their original shape once a deforming force relents.

In some embodiments, a cover (not shown) is provided that latches over the bridge 116 and base 111 and includes a handle for transport of the sleep pod 100 (when it is not in use).

FIG. 3 illustrates another embodiment of the sleep pod 100, sleep pod 100*b*, where the sidewalls 114 are replaced with sidewalls 130. The sidewalls 130 include supports 132 that support a rim 134 and the bridge 116. A mesh liner 136 is provided to cover the spaces between the supports 132, support rim 134, and bed 112, providing separation between the infant sleep area and areas outside the sleep pod 100*b*. Additionally, the mesh liner 136 is breathable to enable the flow of air in and out of the infant sleep area. In some embodiments, the legs 118 of the bridge 116 form three of the supports 132. In some embodiments, the legs 118 of the bridge 116 are coupled to the bed 112 and are separate from the sidewall 130. In these embodiments, the sidewall 130 may be positioned either inside of the legs 118 or outside of the legs 118.

Figure 2A:
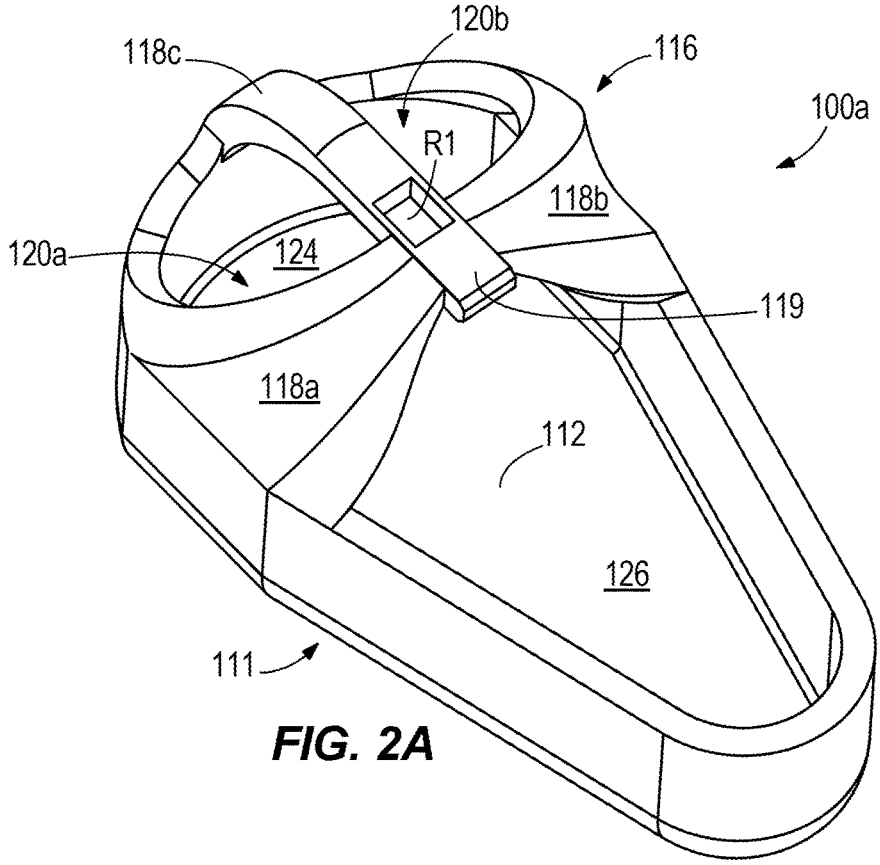
FIGS. 2A-G illustrate an embodiment of the sleep pod.
Figure 2B:
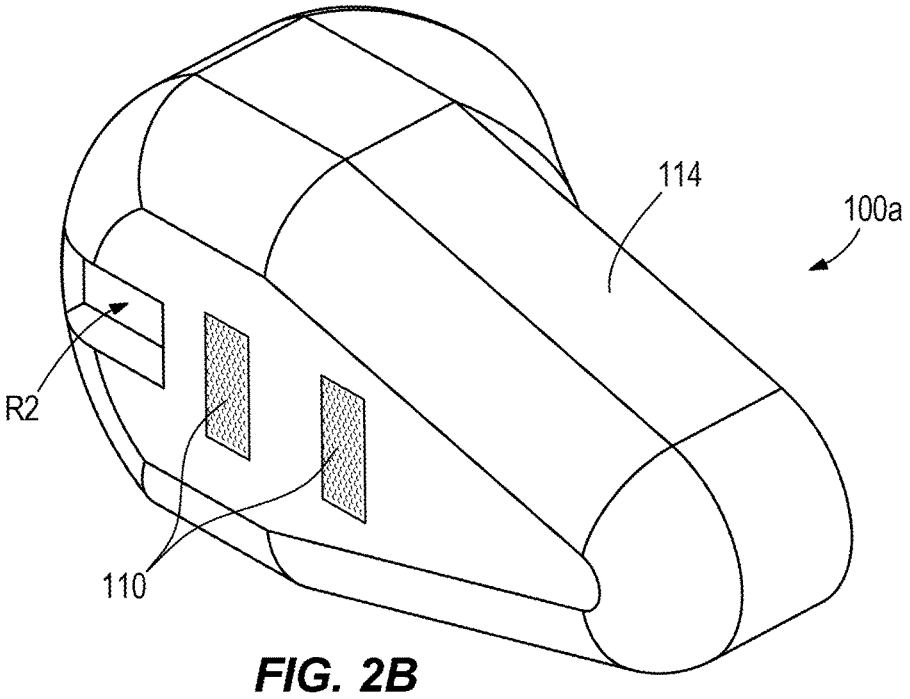
Figure 2C:
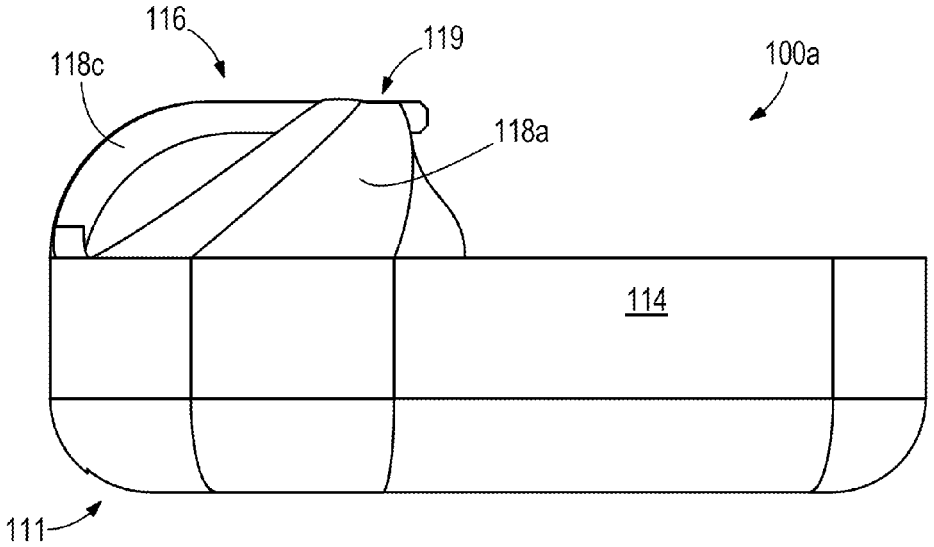
Figure 2D:
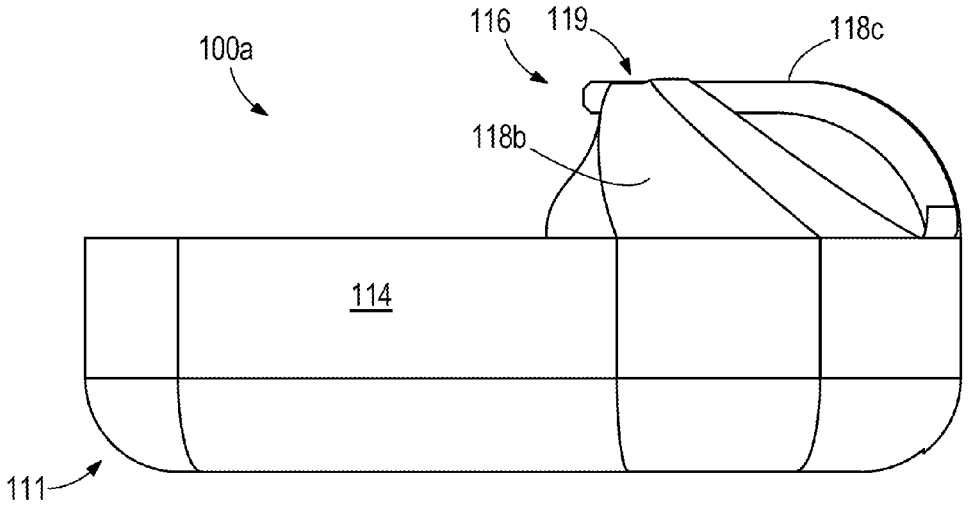
Figure 2E:
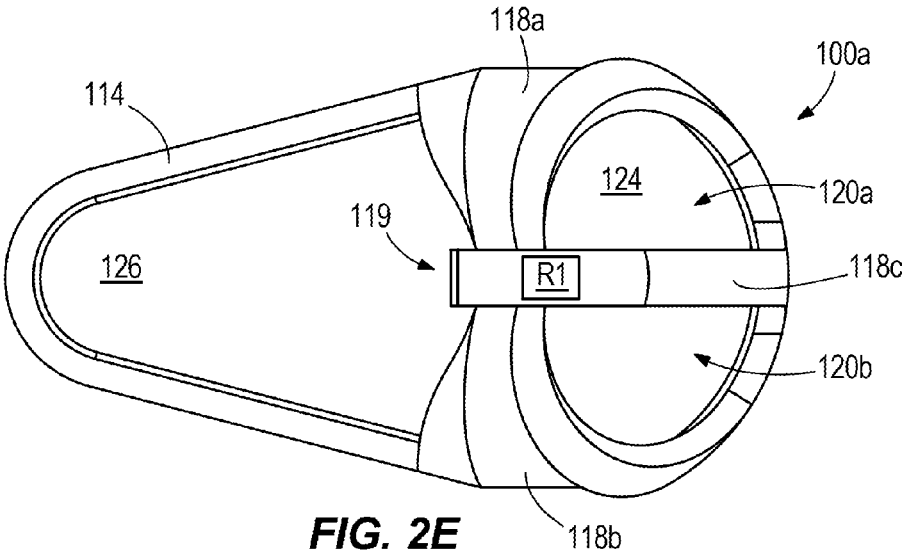
Figure 2F:
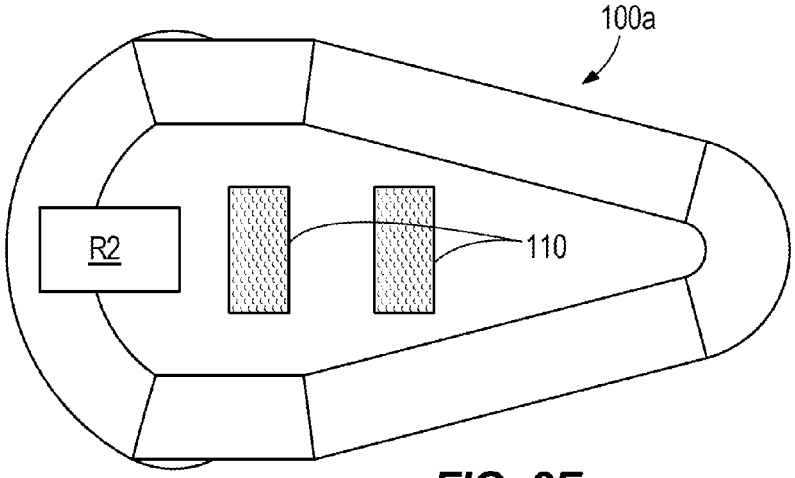
Figure 2G:
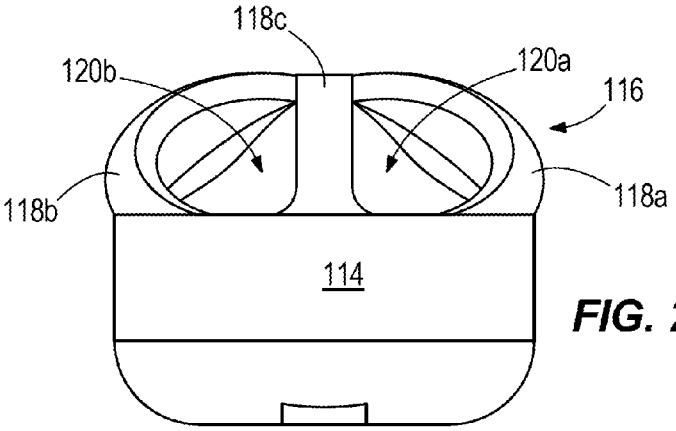
Figure 4A:
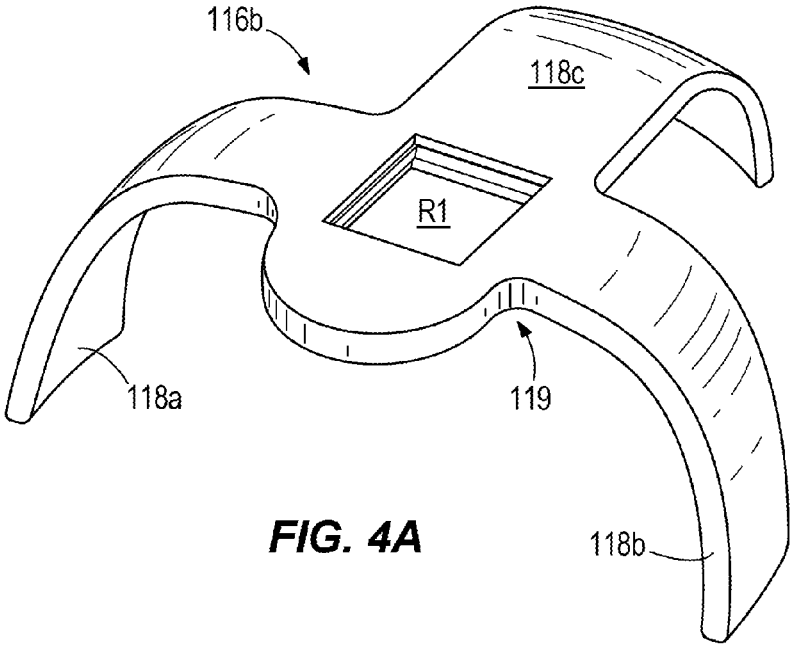
FIGS. 4A-C illustrate bridges for embodiments of the sleep pod.
Figure 4B:
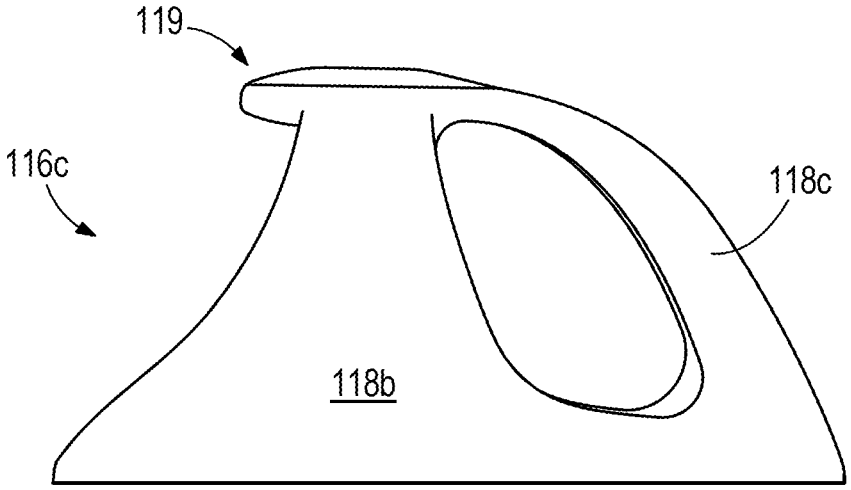
Figure 4C:
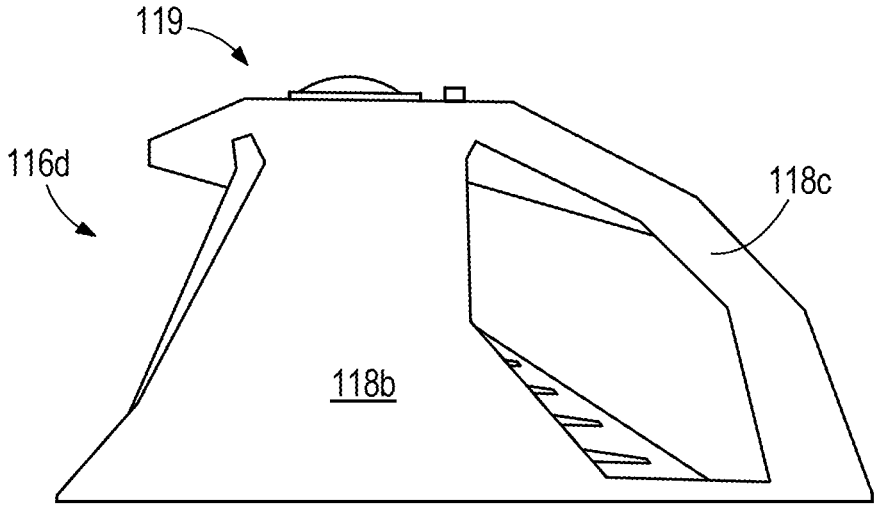

FIGS. 4A-C illustrate additional embodiments of the bridge 116, labeled bridges 116*b-d*, respectively. In some embodiments, the legs 118, particularly the legs 118*a* and 118*b* such as shown in FIG. 2A, may has a narrower width along the sidewall 114 to enlarge the peek spaces 120. For instance, FIG. 4A illustrates a bridge 116*b* that forms a larger peek spaces 120. In some embodiments (not shown), the bridge 116 may not include the first and second peek spaces 120 and, rather, may be an opaque canopy. The opaque canopy may be formed using an opaque liner covering the peek spaces 120, or the legs 118 may be united into a singular canopy.

Figure 5A:
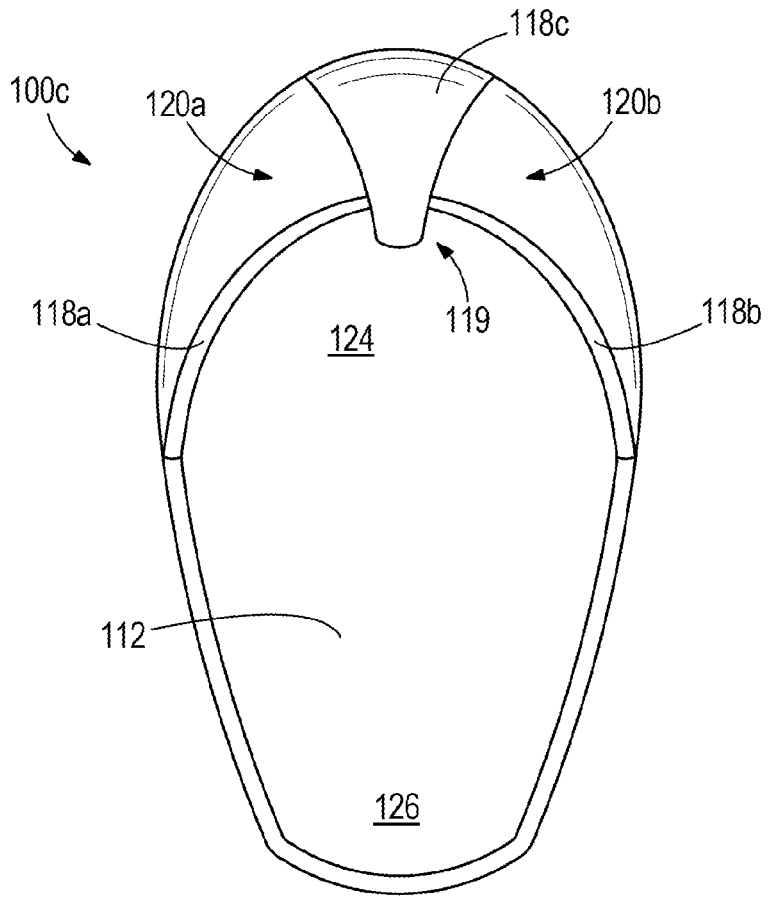
FIGS. 5A-C illustrate additional embodiments of the sleep pod.
Figure 5B:
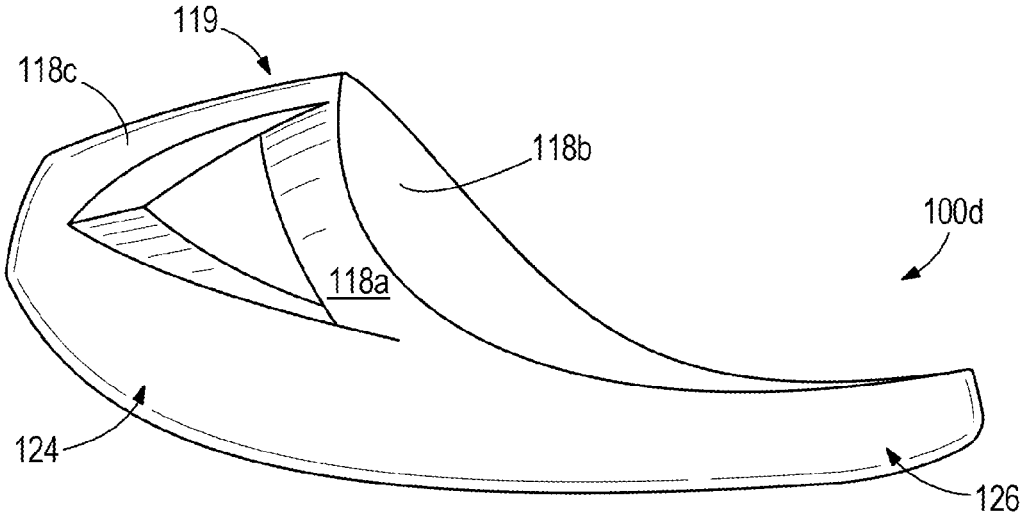
Figure 5C:
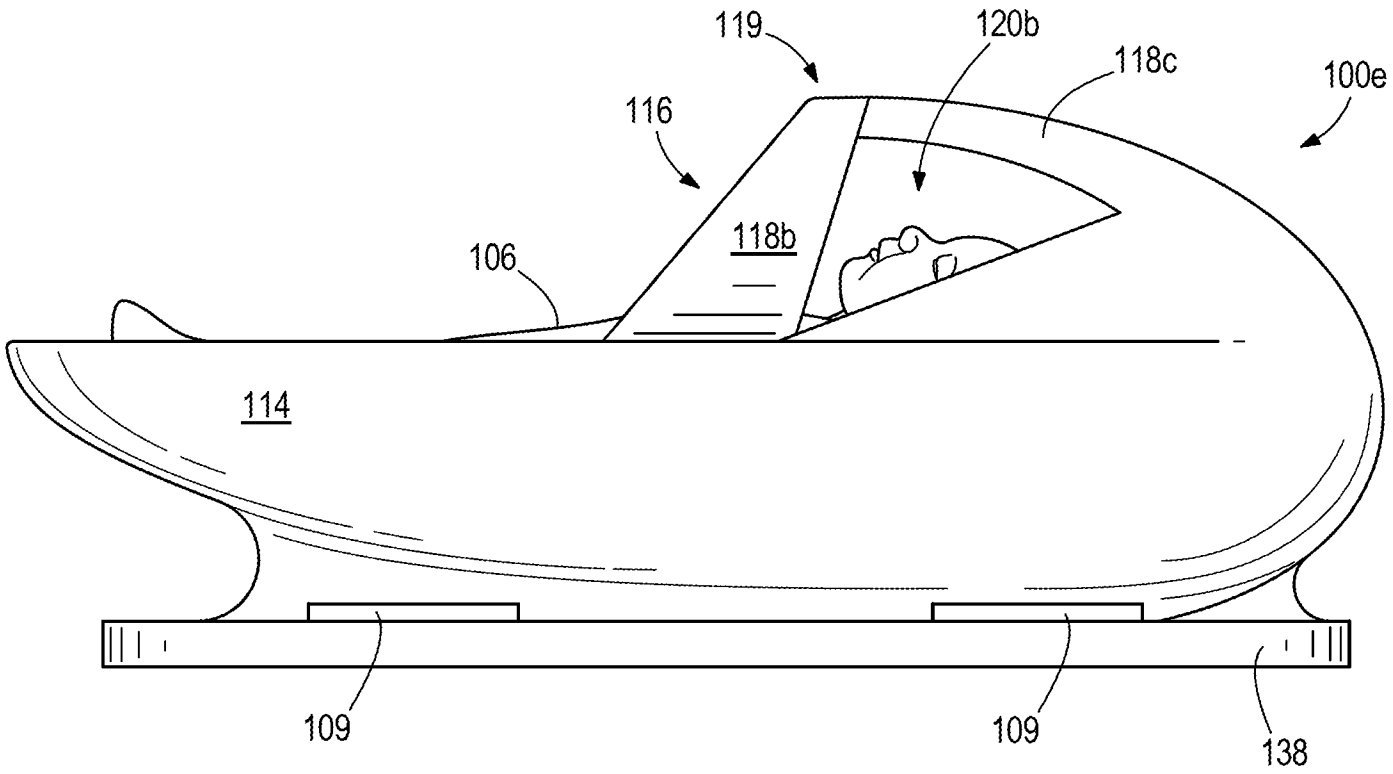

FIGS. 5A-C illustrate sleep pods 100*c*, 100*d*, and 100*e*, respectively, which are further embodiments of the sleep pod 100. The sleep pod 100*c* includes narrow legs 118*a* and 188*b* creating large peek spaces 120. The sleep pod 100*d* includes a curved bed 112 that is elevated at the head portion 124. FIG. 5C illustrates sleep pod 100*e* includes a base 111 having a platform 138 and through holes 140 for the straps 108.

Figure 6A:
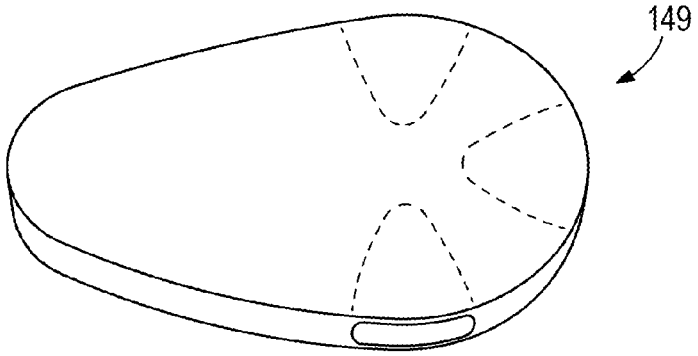
FIG. 6A illustrates a joining portion for embodiments of the sleep pod.
Figure 6B:
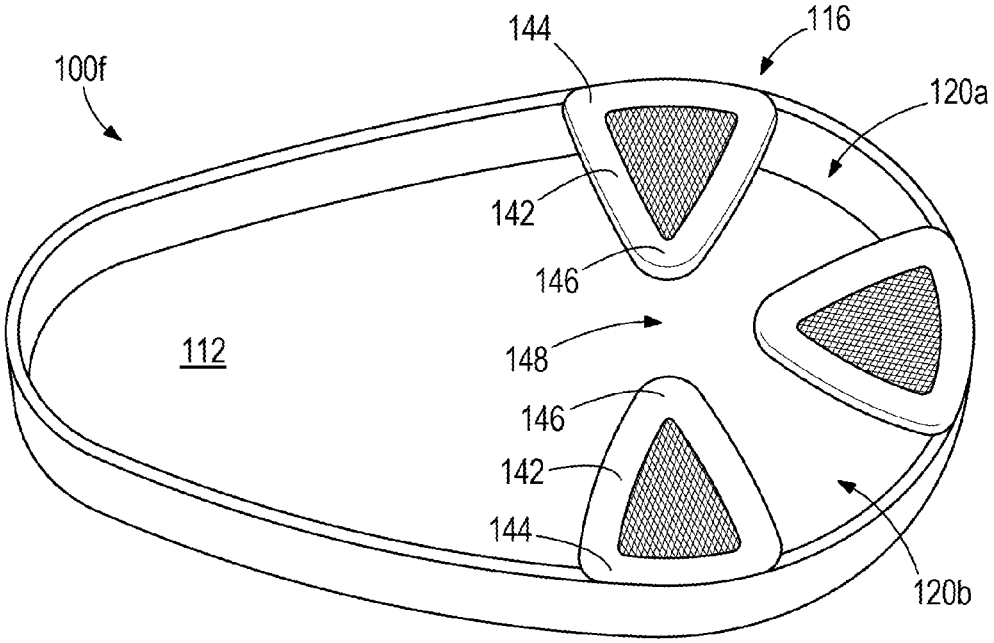
FIG. 6B illustrates another embodiment of the sleep pod.
Figure 7A:
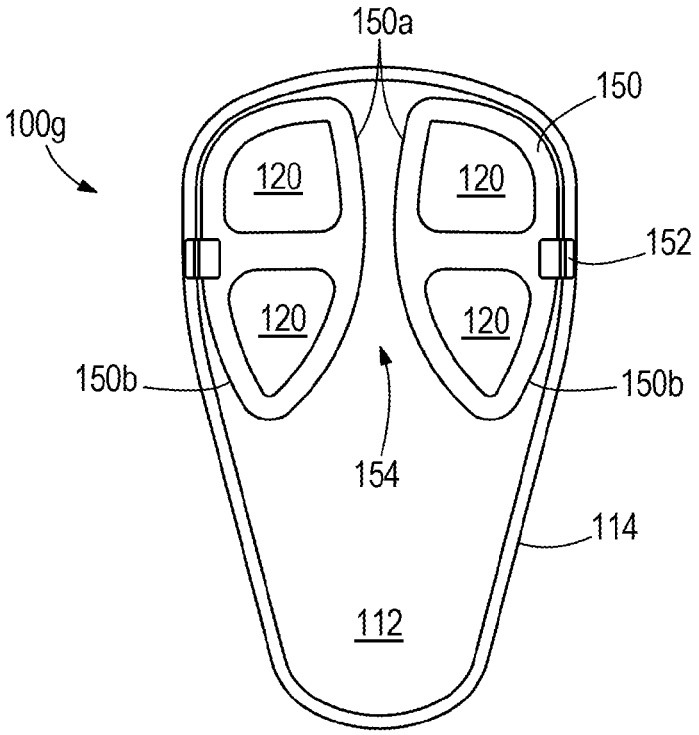
FIGS. 7A-B illustrate another embodiment of the sleep pod.
Figure 7B:
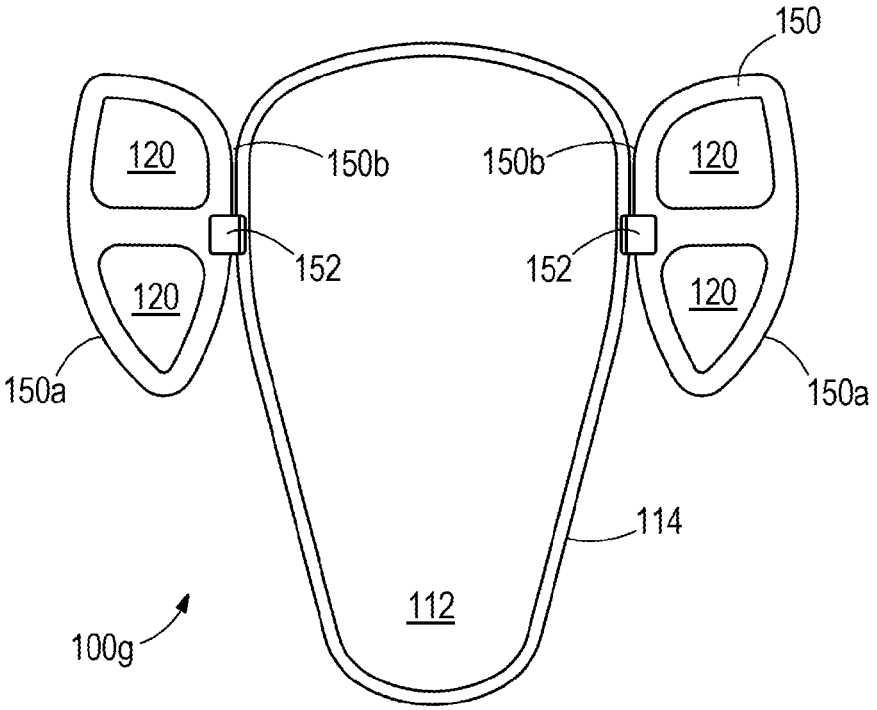

FIGS. 6A and 7A-B illustrate sleep pods 100*f* and 100*g*, respectively, which are further embodiments of the sleep pod 100. The sleep pods 100*f* and 100*g* include bridges 116 with legs that do not join above the bed 112. For instance, the legs 142 of the bridge 116 of the sleep pod 100*f* have a wide base portion 144 attached to the base 111 (e.g., bed 112 or wall 114), and have a narrower peak portion 146. The narrow peak portions 146 are apex ends of the legs 142 that terminate in the apex area above the bed 112. However, the narrow peak portions 146 are separated by a gap 148 and are not joined together. In some instances, the narrow peak portions 146 are joined together akin to other embodiments (see, e.g., FIG. 2A) or are coupled together via a separate joining piece 149 having recesses that selectively attaches to each of the narrow peak portions 146 (see FIG. 6B). In some instances, a joining piece (e.g., 149) may be permanently coupled to one leg of the bridge 116 and selectively coupled to the other legs, to prevent the joining piece from being separated from the sleep pod 100.

The sleep pod 100*g* includes a bridge 116 formed of legs 150, also referred to as wings 150, coupled to the base 111 via hinges 152. The wings have apex ends 150*a* and connecting ends 150*b*. The hinges 152 enable the wings 150 to open (see FIG. 7B) to ease insertion and removal of an infant 106. In the open position, the apex ends 150*a* are beyond the sidewalls 114. In the closed position (FIG. 7A), the apex ends 150*a* of the wings 150 are within the apex area and separated by a gap 154; however, in other embodiments, the wings 150 may abut one another or attach to one another in the closed position. In some embodiments, the hinges 152 are not included and the wings 150 are fixed into the closed position. In some instances, the hinges 152 are incorporated into other embodiments of the sleep pod 100 (e.g., sleep pod 100*a-f*) such that legs (e.g., legs 118) are moveable similar to the wings 150. The gaps 148 and 154 are generally small enough to prevent the infant 106 and foreign objects common to an adult bed (pillows, blankets, etc.) from passing therethrough. The wings 150 each include a peek space 120 separated by a divider to form two peek spaces 120 for each wing 150. As in the other embodiments of the sleep pod 100, the peek space 120 of the sleep pod 100*g* may be covered in a mesh material.

The various embodiments of the bridge 116 share a common protective feature in that they each provide an approximately half-dome (quarter-sphere) of protection above the head portion 124 of the sleep pod 100, and leave open a insertion space in the direction of the foot portion 126. For instance, sleep pod 100*a* provides a protective covering above the head of an infant 106 from the left (leg 118*a*), right (leg 118*b*), and top (leg 118*c*), which generally forms the shape of a half-dome, and the foot portion 126 is left generally open. The various legs 118, 142, and 150 have apex ends that terminate in an apex area above the head portion 124 of the bed 112 approximately halfway between the left and right sides of the sleep pod 100. The apex ends, whether meeting at a joining portion 119 or separated by the gap 148 or 154, are generally at or near the peak height of the bridge 116.

Various combinations of the legs, shapes, mesh liners, bed shapes, etc. of the embodiments illustrated form additional embodiments of the sleep pod 100. Additionally, in some embodiments, other materials are used to construct embodiments of the sleep pod 100. For instance, the bed 112 may be formed from particle board, plastic, or the like. Regardless of the material of the bed 112, a separate mattress or a nonremovable mattress may be provided on the surface of the bed 112. Such a mattress is generally firm. The bridge 116, sidewalls 114 and 130, and/or rim 132 may include metal (e.g., steel) or plastic rods covered in fabric and/or mesh, and may include padding to soften any unintentional impacts between the sleep pod 100 and infant 106, such as during placement and removal of the infant 106. For instance, the rim 132 may be a steel loop mirroring the perimeter of the bed 112, while another steel loop (lower loop) with a similar shape may extend along the perimeter of the bed 112 below the rim 132, and the mesh liner 136 may extend therebetween to create the sidewall 130. The lower loop is integral with or secured to the bed 112, and the rim 132 is held in position above the lower loop by the supports 132.

The sleep pod 100 is generally intended for infants not yet able to sit up on his or her own and that have a length less than the bed 112. In some embodiments, the dimensions are chosen such that the sleep pod 100 is typically used for infants from approximately 0 to six months. However, dimensions of the sleep pod 100 vary depending on the intended age range of the infants. In some embodiments, the bed 112 has a length of between 24-36 inches and a maximum width of between 12-16 inches on the interior. Additionally, the sidewalls 114 and 130 may rise above the surface of the bed 112 by between 3-10 inches, and the top of the bridge 116 may rise above the surface of the bed 112 by between 9-16 inches. The bridge 116 extends out over the bed 112 (lengthwise) between 6-8 inches. For instance, in one embodiment, the infant sleeping area is approximately 28 inches long by 14 inches wide (tapered down towards the foot portion 126) by 6 inches deep, and the bottom of the bridge is 11 inches above the surface of the bed 112 and extends 11 inches out over the bed 112. The dimensions of the sleep pod 100 and the infant sleep area vary in different embodiments, for instance, to accommodate infants of different sizes and age ranges.

Figure 8:
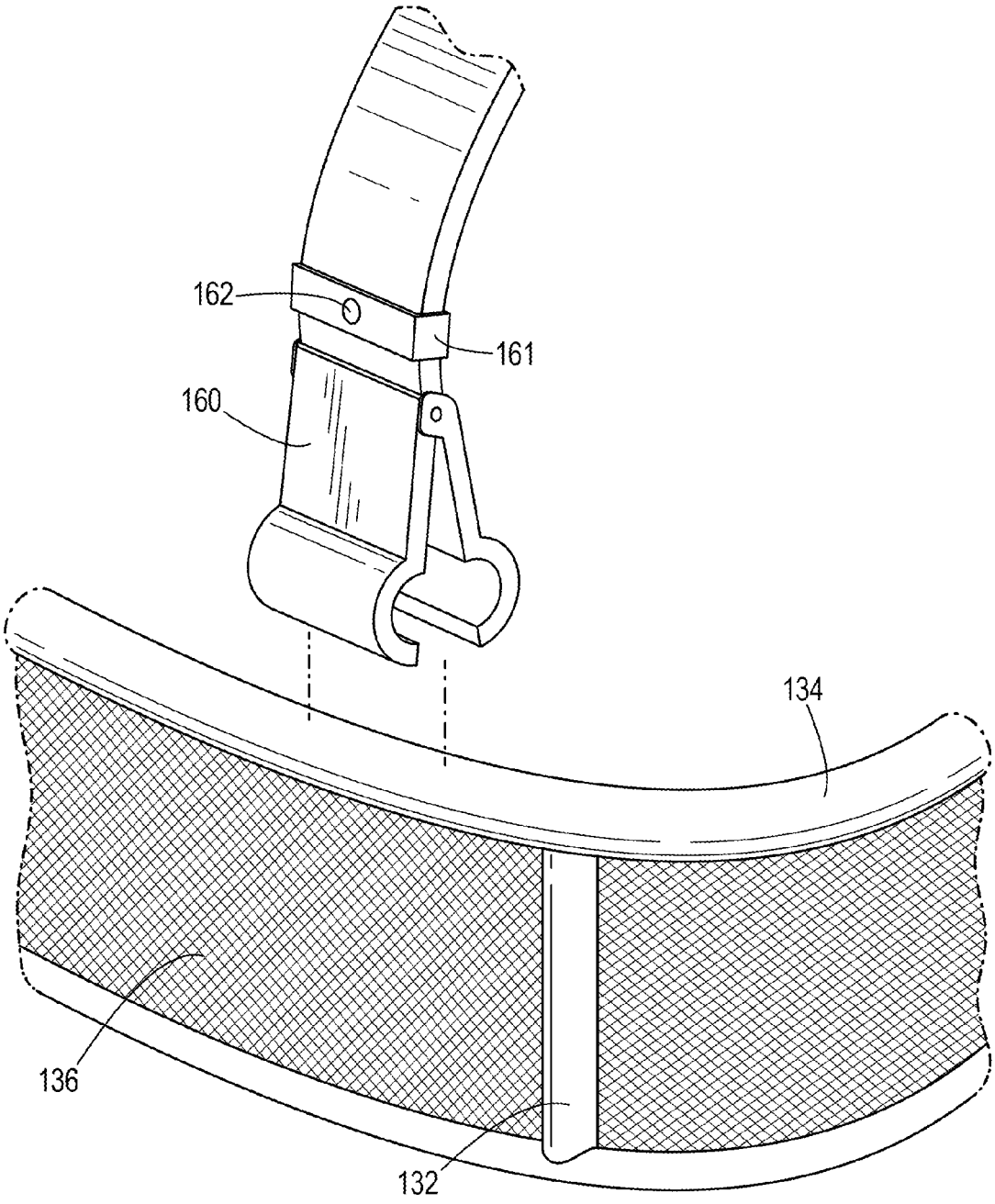
FIG. 8 illustrates a clamp for selectively connecting a bridge.

In some embodiments, the bridge 116 is selectively attachable and removable to/from the base 111 of the sleep pod 100 and various other infant beds. Selectively attaching a bridge 116 to an infant bed that does not come equipped with a bridge (an "open" bed) increases protection for an infant. For instance, the legs 118 of the bridge 116 shown in FIG. 8 include a clamp 160 that can be secured to a rim, such as the support rim 134 in FIG. 3, of an infant bed. The clamp 160 may be secured to a rim by sliding the sleeve 161 down over the clamp arms. The sleeve 161 may lock into place once over the clamp arms, and is selectively releasable by depressing the unlock button 162. The clamp arms may be selectively clamped and released using other techniques, such as fasteners and clasps. The clamp 160 is sized such that it fits and may be secured to various rim sizes and infant beds. In some embodiments, coupling devices other than the clamp 160 are used to selectively secure the bridge 116 to an infant bed or sleep pod 100. In some embodiments, the legs 118 are selectively attachable and removable from a rim near a bottom portion of the walls 114, 136. Selectively attachable and removable components do not include those components that are integrally constructed (e.g., from a single mold) or attached in a permanent manner (e.g., via adhesive, epoxy, etc.). Rather, selectively attachable and removable components may be secured to and removed from one another multiple times without damaging the components.

Sleep Pod Electronics

Figure 9:
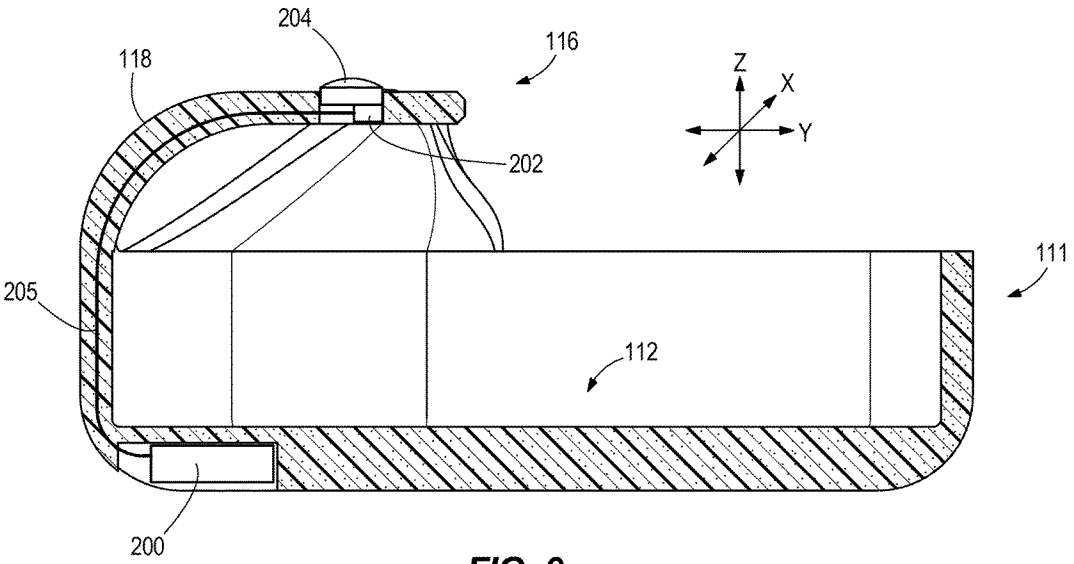
FIG. 9 illustrates an embodiment of the sleep pod including electronics.

In some embodiments, the sleep pod 100 includes electronics. For instance, the sleep pod 100 of FIG. 9 includes a control unit 200, a sensor unit 202, and a user input/output unit ("user I/O") 204, also referred to as a user interface. The communication and power wires 205 connect the control unit 200 to the user I/O 204 and the sensor unit 202. As illustrated, the sensor unit 202 and user I/O 204 are positioned at the top of the bridge 116 where the legs 118 join together (the joining portion 119), while the control unit 200 is positioned in the base 111 below the bed 112. The sleep pod 100 includes a recess R1 to receive the sensor unit 202 and user I/O 204 (see, e.g., FIG. 2A), which may be combined into a single unit, and a recess R2 to receive the control unit 200 (see, e.g., FIG. 2B). In some embodiments, such as embodiments including a selectively attaching bridge 116, the recess R2 and control unit 200 are also incorporated into the bridge 116, rather than the base 111.

The sensor unit 202 includes one or more sensors for monitoring the sleep environment of the sleep pod 100 and/or the infant 106. Unless otherwise noted, monitoring or sensing characteristics of the sleep pod 100 includes monitoring and sensing characteristics of the sleep pod 100, the environment in/around the sleep pod 100, and the infant 106. Stated another way, the sensor unit 202 senses one or more characteristics of the infant sleep pod 100, such as ambient and/or body temperature, sound emission (of the infant), infant motion, pod acceleration, pod position/tilt, pod velocity, infant weight, blockage (e.g., from a pillow, blanket, or adult covering a portion of the sleep pod 100 or infant 106), and visual data (e.g., via a camera). The user I/O 204 provides an interface between the user and the sleep pod 100, and includes both input features and output features. The control unit 200 is the central controller for the sleep pod 100 and is in communication with the sensor unit 202 and the user I/O 204.

Figure 10:
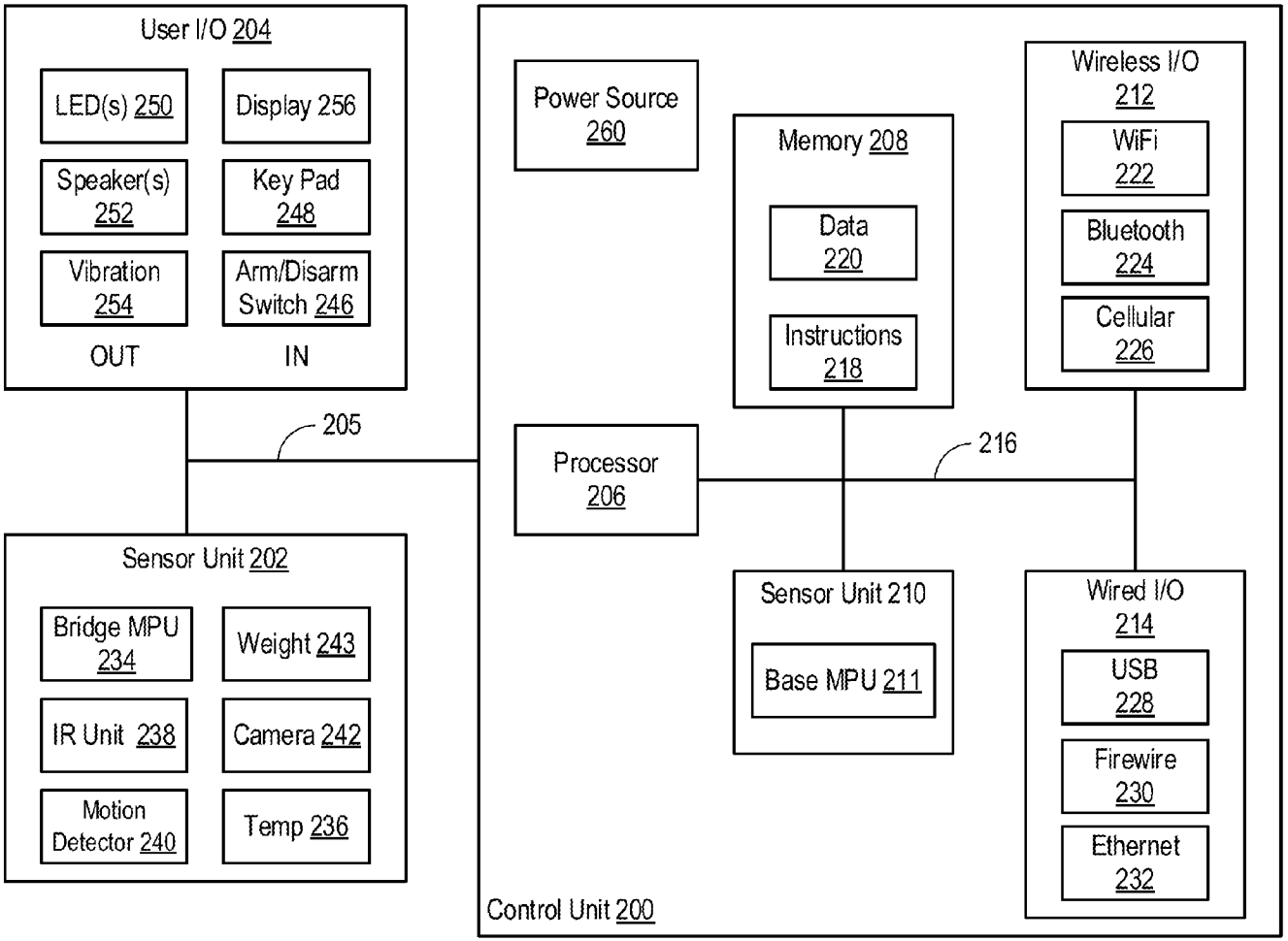
FIGS. 10-11 illustrate block diagrams of sleep pod electronics.

FIG. 10 illustrates a block diagram of the electronics of the sleep pod 100. The control unit 200 includes a processor 206, a memory 208, sensor unit 210, a wireless I/O module 212, and wired I/O module 214. The components of the control unit 200 communicate via one or more connections, illustrated in FIG. 10 as bus 216. The processor 206 executes instructions 218 stored on the memory 208, which may be flash memory, a hard disk, etc. The memory 208 also includes data 220 that may include parameters and thresholds used in monitoring software for the sleep pod 100, sensor data obtained from sensor unit 210 and sensor unit 202, and other data. The sensor unit 210 includes one or more sensors, such as provided in a motion processing unit (MPU) 211, to obtain data to be used in conjunction with or in place of data obtained via the sensor unit 202.

The wireless I/O module 212 includes one or more wireless communication units, such as WiFi® unit 222, Bluetooth® unit 224, and cellular unit 226, enabling the control unit 200 to communicate with external devices, which is explained in further detail below. Similarly, the wired I/O module 214 include one or more wired communication ports, such as USB® port 228, Firewire® port 230, and Ethernet® port 232, enabling the control unit 200 to communicate with external devices. Other wireless and wired communication units may be included in the modules 212 and 214 to enable communications with external devices 300 using other wireless and wired communication protocols. The modules 212 and 214 are also usable to provide firmware updates to the memory 208 of the control unit 200 from an external device.

As noted above, the sensor unit 202 provides monitoring functions for the sleep pod 100. The sensors unit 202 includes one or more of a motion processing unit (MPU) 234, temperature sensor 236, infrared material detector 238, motion detector 240, camera 242 (video or still), weight sensor 243, and other sensing devices.

The user I/O 204 includes one or more push buttons that the user employs to activate/arm and to deactivate/disarm the sleep pod electronics, referred to as an arm/disarm selector or switch 246. The user I/O 204 may also include a keypad 248 that allows the user to set and alter trigger/threshold points (e.g., high temperature threshold, motion sensitivity, etc.), and otherwise configure the sleep pod 100. Additionally, the user I/O 204 outputs information to a user through light—such as different colored lights (e.g., green, yellow, red), flashing lights, and light patterns, through sound, and/or through tactile feedback (e.g., vibration). Accordingly, the user I/O 204 includes one or more of lights 250 (e.g., light emitting diodes (LEDs) 250), speakers 252, and vibration generators 254. The user I/O 204 is thus operable to inform a user whether the sleep pod 100 is activated, whether an alert exists, whether a system failure is occurring, as well as other information. The output components (e.g., LEDs 250, speakers 252, and vibration generators 254) used for indicating an alert may be referred to as alert output devices. The lights 250 may further include a light positioned on the bottom of the bridge 116 to illuminate the sleep area. The light for illuminating the sleep area is chosen to minimize effects on the circadian rhythm of the infant 106.

Figure 13:
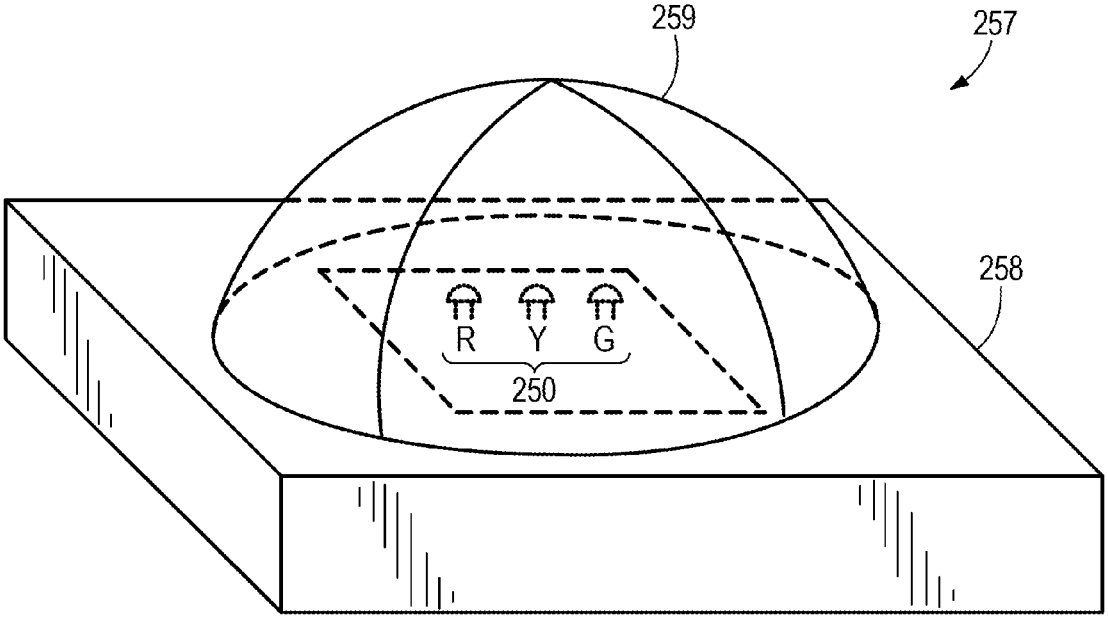
FIG. 13 illustrates a user interface for embodiments of the sleep pod.

FIG. 13 illustrates an embodiment of the user I/O 204 and sensor unit 202 incorporated as a single unit 257 for insertion into the recess R1 of the bridge 116. The unit 257 includes a housing 258 and a dome 259. The dome 259 is transparent or translucent to allow light emitted from the red (R), yellow (Y), and green (G) LEDs 250 to pass therethrough. Additionally, the dome 259 is linked to a push-button (not shown) serving as the arm/disarm switch 246. For instance, the bottom of the dome 259 may abut a push-button on top of a circuit board (not shown) of the user I/O 204 within the housing 258 such that depressing the dome 259 depressed the push-button.

In some embodiments, when the sleep pod 100 deactivated or disarmed, none of the LEDs 250 are emitting light. When the user depresses the dome 259, the sleep pod 100 is armed and the green (G) LED 250 emits light, causing the dome 259 to appear green. Upon arming, the control unit 200 begins monitoring the infant 106 and sleep environment. Upon detection of an unsafe condition, the control unit 200 generates an alert. If the alert is not severe and merely a warning, the yellow (Y) LED 250 begins emitting light and the green LED 250 ceases emitting light, causing the dome 250 to appear yellow. If the alert is more severe and includes an alarm, the red (R) LED 250 being emitting light and the green and yellow LEDs 250 do not emit light, causing the dome 259 to appear red. To reset the sleep pod 100, a user may depress the dome 259. Assuming the unsafe conditions have been alleviated, only the green (G) LED 250 emits light, again causing the dome 259 to appear green. Thus, the green light indicates an armed sleep pod 100 having no alerts; the yellow light indicates an armed sleep pod 100 having a warning condition; and the red light indicates an armed sleep pod 100 having an alarm condition. This is but one exemplary scheme for the user I/O 204 and arming/disarming the sleep pod 100.

In some instances, the user I/O 204 includes a display 256 in place of or in conjunction with the LED(s) to provide additional output capabilities, such as text. In some instances, the display 256 is a touchscreen providing input capabilities as well, which could be used in place of the key pad 248 and/or the arm/disarm switch 246.

In some instances, one or more of the user I/O 204 and the sensor unit 202 communicate with the control unit 200 using one or more of the wireless I/O module 212 and the wired I/O module 214, rather than via the wires 205. In some instances, the user I/O 204 is implemented via a unit separate from the sleep pod 100, such as a smart phone, laptop, or a remote device dedicated to the sleep pod 100. For instance, a user can communicate and control the sleep pod 100 using a smart phone as the user I/O 204 via WiFi® or Bluetooth® communications, and, similarly, the sleep pod 100 can output information to the smart phone via the same wireless techniques. In some instances, the user can communicate and control the sleep pod 100 using a personal computer as the user I/O 204 via a wired and/or wireless home network (e.g., WiFi® and/or Ethernet®) or over the Internet.

The control unit 200 further includes a power source 260. The power source 260 is, for instance, a battery. The battery is designed to function for at least the life of the sleep pod 100 through a single infant's use (e.g., about 6 months). In other embodiments, the power source 260 is a rechargeable battery that may either be removed for recharging or may recharge in place upon coupling the control unit 200 to an external power source (e.g., a standard wall outlet, a USB® line, solar panel, etc.). When the power source 260 includes a battery, the controller 200 is operable to detect a low battery and provide an indication of such via the user I/O 204. As illustrated, the power source 260 also powers the sensor unit 202 and user I/O 204 via power/communication lines 205. In some instances, one or both of the user I/O 204 and sensor unit 202 includes an additional power source (not shown) independent of the power source 260 and control unit 200.

The control unit 200 is further operable to run self-diagnostic tests using diagnostic software stored on the memory 208. The diagnostic software is operable to detect sensor degradation of the sensors of the sensor units 202 and 210, errors with the components of the user I/O 204, etc. Errors detected via the diagnostic software are output to a user via one or more of the user I/O 204, wireless I/O module 212, and wired I/O module 214.

The sensor units 202 and 210 provide various monitoring capabilities for the sleep pod 100. In general, each sensor provides an output to the processor 206, and the processor 206 analyzes the output and determines whether an unsafe situation is present. If an unsafe situation is detected based on the sensor output, the processor 206 generates an alert, such as a warning (lower level alert) or alarm (higher level alert). The generated warnings and alarms may manifest in different ways, depending on the severity of the unsafe condition, the available user output features of the user I/O 204, and existence of external devices in communication with the control unit 200. In general, however, the controller 200 generates progressively more intense or noticeable alerts to indicate unsafe conditions of different severity levels. For instance, a warning may involve one or more of illuminating a yellow LED of the LEDs 250, generating a mid-level volume beep or other sound via speakers 252, or a mid-level vibration output by the vibration generator 254. Additionally, an alarm may involve one or more of illuminating a red LED of the LEDs 250, generating a high-level volume beep or other sound via speakers 252, or a high-level vibration output by the vibration generator 254. Similarly, the LEDs 250 may flash for warnings and alarms in different ways such that a color-blind user could distinguish between a warning and an alarm. In some instances, a warning results in fewer user outputs than an alarm. For instance, a warning may include illuminating a yellow LED of the LEDs 250, while an alarm includes illuminating a red LED of the LEDs 250, causing an audible alert sound via speakers 252, and causing a vibration output by the vibration generator 254. Other combinations of output features of the user I/O 204 are used in other embodiments to progressively indicate unsafe conditions.

Figure 11:
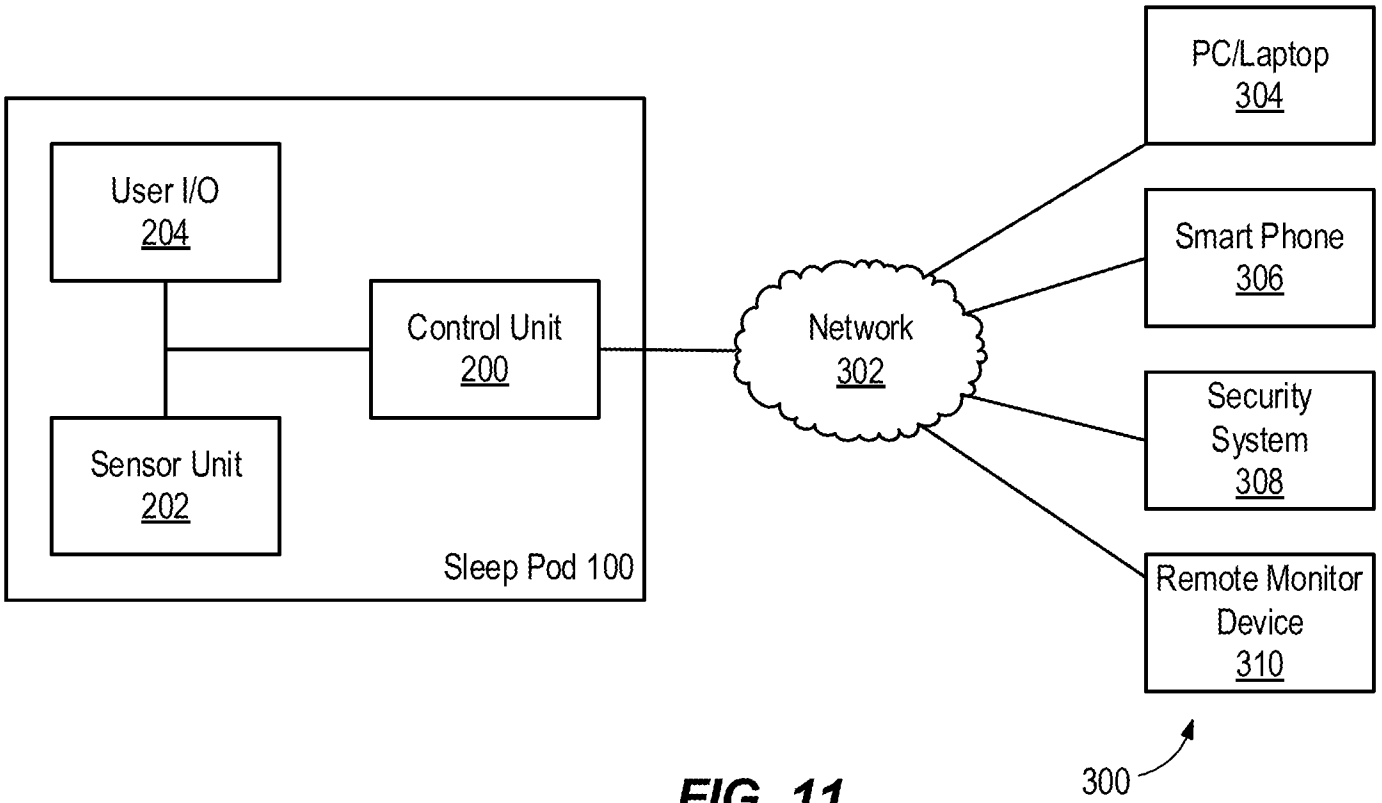

In some embodiments, either in place of or in combination with alerts generated using the user I/O 204, the controller 200 may communicate alerts to external devices 300 communicatively coupled to the control unit 200. As shown in FIG. 11, the smart pod 100 uses the wireless I/O 212 and/or wired I/O 314 to communicate with the network 302 and external devices 300. The external devices 300 include a personal computer or laptop 304, a smart phone 306, a home security system 308, and a remote monitoring device 310. Although the network 302 is illustrated as connecting the sleep pod 100 to the external devices 300, the sleep pod 100 is also operable to directly communicate with one or more of the external devices 300. The communications between the sleep pod 100 and the external devices 302 may be wireless, wired, or a combination thereof. For instance, the sleep pod 100 may directly communicate with the smart phone 306 using a wireless communication protocol such as Bluetooth®, and communicate with the home security system 308 using a WiFi® connection to the network 302 and a wired Ethernet® connection between the network 302 and the home security system 308. Additionally, the laptop 304 may be located more remotely (e.g., a different address, city, state, or country) and the network 302 may include the Internet to enable communications with the sleep pod 100. The control unit 200 is operable to generate communications, such as one or more of text messages (e.g., short message service (SMS) messages), email messages, and automated voice messages, for delivery to one or more of the external devices 300. In some embodiments, other combinations of wired, wireless, direct, and indirect communications between the sleep pod 100 and external devices 300 are implemented. The remote monitoring device 310 may be a specific handheld portable device made for use with the sleep pod 100 and may replicate the look and feel of the user I/O 204.

In some embodiments, the external devices 300 include particular software for interacting with the sleep pod 100. For example, the smart phone 306 may include a sleep pod software application ("sleep pod app") executed thereon for receiving and emitting alerts from the sleep pod 100, for receiving and displaying sensor data from the sleep pod, for arming/disarming the sleep pod 100, for configuring the sleep pod 100 (e.g., setting thresholds), and for controlling the sleep pod 100 (e.g., activating lights and generating sounds of the sleep pod 110). Additionally, in some embodiments, the external devices use a general purpose application, such as a web browser, to access web-based application for interacting with the sleep pod 100.

As noted above, and returning to FIG. 10, the processor 206 uses the sensor unit 210 and sensor unit 202 to detect unsafe conditions. The MPU 211 includes a three-axis gyroscope, a three-axis accelerometer, and a digital motion processor hardware accelerator. The MPU 211 is operable to detect one or more motion parameters including tilt, acceleration, rotation, collision, free fall, and vibration of the sleep pod 100, and to transmit the sensed motion parameters (motion data) to the processor 206. For instance, the MPU 211 may be an MPU-6050 motion sensing unit produced by InvenSense.

The processor 206 uses the received motion data in control software executing on the processor 206. The processor 206 is operable to compare the motion data with one or more thresholds to determine whether an unsafe situation is occurring. For instance, the thresholds may include a warning threshold and an alarm threshold stored in memory 208, wherein the warning threshold is a lower concern than the alarm threshold. For example, when an acceleration level exceeds the warning threshold, a warning is generated by the processor 206, and when the acceleration levels exceed an alarm threshold, an alarm is generated. The thresholds are generally set so that slight movements of the sleep pod 100 do not exceed an alert threshold and do not generate warnings or alarms. However, the alert thresholds are set to detect when the (armed) sleep pod 100 is, for instance, falling or being moved by a user too quickly. Furthermore, the processor 206 is also operable to compare tilt and/or angular acceleration data to thresholds to determine if the sleep pod 100 is tipping or has tipped over. Additional or fewer thresholds and corresponding alert types are implemented in other embodiments. In some instances, the unsafe condition is detected by the motion processing unit, such as a free fall condition. The free fall condition may be determined upon detecting that the accelerometer output along all three axes has an absolute value below a user programmable acceleration threshold. The MPU 211 indicates the free fall condition to the processor 206, and the processor 206 generates an alert.

In some embodiments, rather than an MPU 211 including on-board processing hardware, the MPU 211 includes one or more motion sensors (e.g., an accelerometer and a gyroscope) that output analog or digital signals directly to the processor 206 for processing. These motion sensors may be integrated in a single integrated circuit, mounted separately as discrete sensors on a printed circuit board, etc.

Additionally, different thresholds may be used for each sensed direction of movement, such that, for instance, the warning threshold for movement along the x-axis is different than the warning threshold for movement along the y-axis, and/or the warning threshold for movement in the positive z-axis direction (up) is different than the warning threshold for movement in the negative z-axis direction (down). The spatial positioning and movement of the sleep pod 100 is described with reference to the x, y, z Cartesian coordinate system herein, with the x-axis extending across the sleep pod from left to right, the y-axis extending across the sleep pod from top to bottom, and the z-axis extending up-down through the sleep pod (see, e.g., FIG. 9). However, in some embodiments, the x-, y-, and z-axes are assigned differently (e.g., the y-axis may extend up-down through the sleep pod 100), or the polar coordinate system, the cylindrical coordinate system, or another coordinate system is used in implementing motion-based monitoring.

The processor 206 may use the output of the MPU 234 similar to its use of the output of the MPU 211 for detection of unsafe conditions. In some instances, only one of the MPU 234 and the MPU 211 are included in the sleep pod 100. In other instances that include both MPUs 211 and 234, the processor 206 may also implement an unsafe condition detection technique using outputs (motion data) from both MPUs 211 and 234.

With two MPUs 211 and 234 positioned at different locations on the sleep pod 100, the processor 206 is operable to determine more specific and/or accurate movement of the sleep pod 100, such as deflections/deformations of the bridge 116 and/or more accurate rotational movement of the sleep pod 100. Thus, the processor 206 is operable to more accurately determine whether the sleep pod 100 is tipping, or has tipped, forward, backward, leftward, or rightward, any of which would qualify as an unsafe condition. A difference in movement detected by the MPU 211 and the MPU 234 along a particular axis indicates rotation. For example, the processor 206 can detect a tipping condition for the sleep pod 100 when the MPU 211 (positioned in the base 112) indicates movement in the positive x-axis direction, while the MPU 234 (positioned in the bridge 116) indicates movement in the negative x-axis direction, if the difference in movement is above a threshold. Exceeding a first threshold may indicate a near-tip condition is present, and exceeding a second threshold may indicate an actual tip has occurred. Motion data from additional axes may also be incorporated into the tipping detection. For instance, in addition to detecting a difference in movement along one of the x and y axes, the MPU 234 of the bridge 116 may also need to show downward (e.g., negative z-axis) movement above a certain threshold to trigger detection of a tipping condition. The particular thresholds used to detect a tipping condition depend in part on the particular locations of the MPU 211 and 234, the shape of the sleep pod 100, and user settings. Upon detection of a tipping condition, the processor 206 generates an alert, such as an alarm for an actual tip and a warning for a near-tip.

The bridges 116 of the various sleep pods 100 are constructed with enough rigidity to support and protect an infant 106 from a blanket, pillow, or other similar foreign objects. However, the bridges 116 are also constructed to have some flexibility such that, under weight of an object such as a pillow, the bridge 116 partially deforms or flexes. The MPU 234 in the bridge 116 senses movement thereof upon such a deformation or a deformation caused by a larger weight, such as an adult rolling onto the sleep pod 100. Since the two MPUs 211 and 234 have a fixed physical relationship provided by the structure of the sleep pod 100 under normal circumstances, movement in one MPU should correspond to movement in the other MPU. Thus, if the motion sensed by the MPU 234 does not correspond to the motion detected by the MPU 211 in the base 112, the processor 206 may detect the deformation of the bridge 116 and output an appropriate alert.

In one embodiment, the two MPUs 211 and 234 enable construction of a two-planar relationship between the physical positions of the MPUs in the bridge 116 and base 112, respectively. The processor 206 uses the offset in MPUs' planar positioning to determine whether to generate an alert. For example, at rest, both planes are parallel to each other, with the plane of the MPU 234 above the plane of the MPU 211. However, upon a deformation of the bridge 116, the planes of the MPUs 211 and 234 become misaligned. If the misalignment exceeds a threshold, an alert is generated to indicate the deformation. The aggressiveness of the alert may depend on the amount of deformation detected, such that a slight flexing may only cause a warning, while a significant collapse of the bridge 116 would generate an alarm.

In some embodiments, other sensors, such as pressure or spring-based sensors, are in communication with the processor 206 and are incorporated into the bridge 116, walls 114, and/or bed 112 to detect deformations thereof.

Figure 12A:
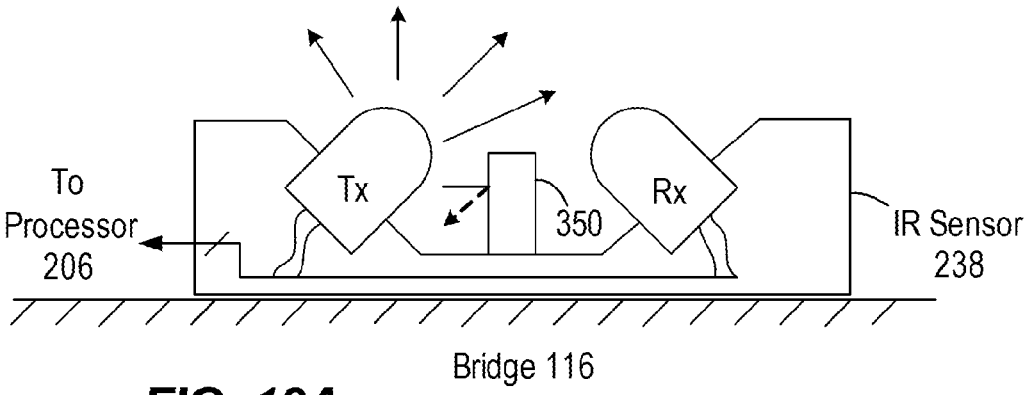
FIGS. 12A-C illustrate an infrared material detector for embodiments of the sleep pod.
Figure 12B:
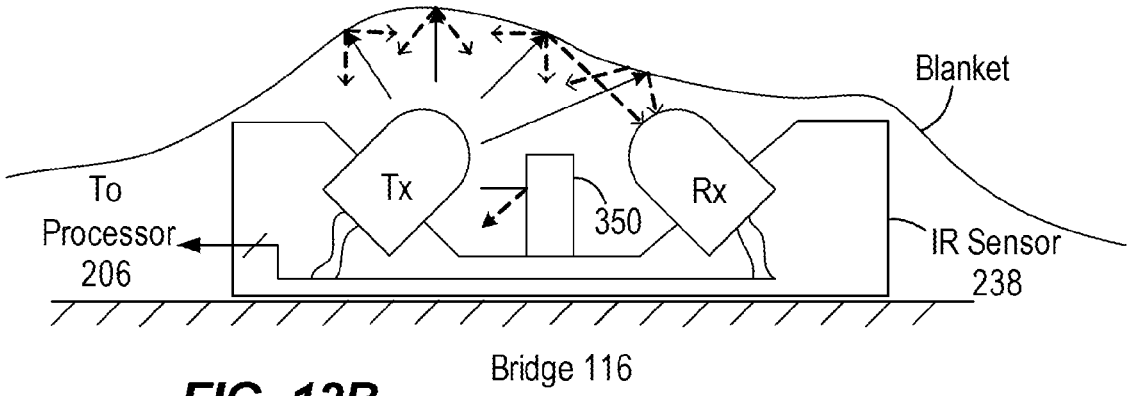

The IR sensor 238, also referred to as an infrared material detector, is operable to indicate to the controller 206 that a blanket, pillow, or other foreign object is covering the sleep pod 100. FIGS. 12A-B illustrate the IR sensor 238 in one embodiment. The IR sensor 238 is positioned on top of the bridge 116, such as at the joining portion 119. The IR sensor 238 includes an IR transmitter (Tx) and an IR receiver (Rx) angled towards each other, with a divider 350 positioned therebetween. The IR transmitter Tx outputs an infrared signal having a predetermined pattern, such as several pulses spaced apart by a certain time period (e.g., 200 ms). The divider 350 prevents transmissions from the IR transmitter Tx from being directly received by the IR receiver Rx. If no foreign object is present, such as shown in FIG. 12A, the output infrared signal is transmitted, but no reflections are received by the IR receiver Rx. If a foreign object, such as a blanket 352, is on top of the IR sensor 238, the infrared signal transmitted by the IR transmitter Tx is reflected back towards the IR receiver Rx. If the predetermined pattern is received by the IR receiver Rx for a first amount of time (e.g., 3-5 seconds), a warning is generated by the processor 206, and for a second amount of time (e.g., 30 seconds), an alarm is generated by the processor 206. Additional progressive thresholds and alerts may be included as well.

Figure 12C:
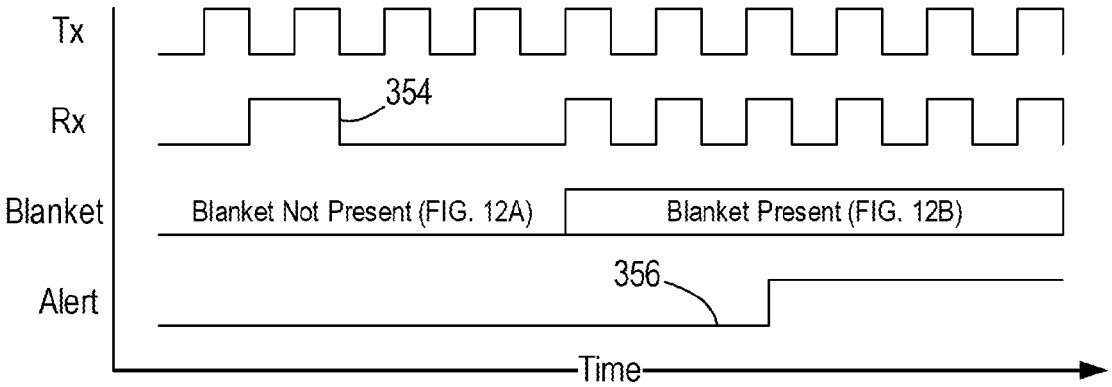

FIG. 12C illustrates a timing diagram of the IR transmitter Tx, receiver Rx, alert generated by the processor 206, and blanket 352. Emitting and detecting a predetermined pattern of infrared signals prevents erroneous alerts caused by other sources of infrared signals received by the IR receiver Rx, such IR signal 354. FIG. 12C also illustrates a delay 356 after the blanket 352 is positioned over the IR sensor 238, but before the alert is generated. Assuming 200 ms IR pulses, the delay 356 is shown to be much shorter than generally used for ease of illustration.

In some embodiments, the sensor unit 202 includes the temperature sensor 236. The temperature sensor 236 is operable to detect ambient temperature and/or surface temperature of the infant 106. For instance, the temperature sensor 236 includes an ambient temperature sensor that outputs a signal representative of the air temperature in and/or around the sleep pod 100. In addition to, or instead of, the ambient temperature sensor, the temperature sensor 236 includes a directional temperature sensor, such as one that calculates temperature by emitting an infrared signal and analyzing reflections of the emitted infrared signal. The directional temperature sensor is aimed downward from the bridge 116 towards the bed 112 and infant 106. Thus, the directional temperature sensor is operable to detect the external surface temperature of the infant 106.

The processor 206 receives the detected temperature signals and compares the detected temperature to various thresholds to determine if an unsafe condition is present, or whether a less-than-ideal temperature is present. If an unsafe or undesirable temperature is present, the processor 206 generates an alert. Although default temperature ranges are provided, particularly to indicate unsafe temperatures, a user may set a desirable temperature range using the user I/O 204. Accordingly, the sleep pod 100 is operable to alert parents or others when the infant 106 is subject to excessively cold or hot temperatures via an alarm, or is outside of a desired temperature range set by the parent via a warning.

In some embodiments, the sensor unit 202 includes the motion detector 240 for detecting motion or movement of the infant 106 (rather than positioning, tilting, or movement of the sleep pod 100). The motion detector 240 includes, for instance, a passive infrared (PIR) or active infrared sensor that detects changes in heat to infer movement; an ultrasonic sensor that emits ultrasonic wave pulses and measures reflections off of an object to infer movement; a microwave sensor that emits electromagnetic pulses and measures the change in frequency from reflections to infer movement based on the Doppler effect; or a combination of two or more of the above. In some instances, one or both of the motion processing units (MPUs) 211 and 234 also act as the motion detector 240 and infer motion of the infant 106 based on detected accelerations. The motion detector 240 is operable to detect movement of the infant 106, such as caused by breathing, and provide a signal of the detected motion to the processor 206. If the motion detector 240 does not detect motion for a certain period of time, the processor 206 is operable to generate an alert. Thus, if an infant 106 stops breathing, the sleep pod 100 is operable to alert parents or others so that they may quickly take action. Although one or more default time thresholds are provided, e.g., five or ten seconds, a user may change the time threshold used by the sleep pod 100. Additionally, a user may set a first threshold (e.g., five seconds) that, when crossed, causes a warning, and a second threshold (e.g., ten seconds) that, when crossed, causes an alarm to indicate a potentially more serious situation.

In some embodiments, the processor 206 detects excessive and/or non-periodic motion by the infant 106, which implies that the infant 106 is awake. In turn, the processor 206 generates an alert to notify parents that the infant 106 is awake.

In some embodiments, the sensor unit 202 includes a camera 242. The camera 242 captures image data and provides the image data to the processor 206. In some instances, the camera 242 periodically sends or is triggered to send a single image capture (e.g., a photograph). In other instances, the camera 242 captures video, which generally includes multiple frames of image data per second.

The image data received by the processor 206 may be saved in the memory 208 temporarily (e.g., to buffer data for export to external devices 300) or for longer period of time for accessing in the future by a local or remote user. When the user I/O 204 includes the display 256, the user may navigate a file structure of the memory 208 to select images or videos from the camera 242, which are then shown on the display 256. In some embodiments, the image data provided to the processor 206 is transferred to an external device 300. The image data may be transferred in real time to a user of the external device 300. For instance, a parent at a location remote from the sleep pod 100 (e.g., a different room of a house, at work, or travelling) may stream video from the camera 242 to a smart phone 306 or laptop 304. Additionally, a remote user of one of the external devices 300 may navigate the file structure of the memory 208 to select images or videos from the camera 242, which are then shown on a display screen of the external device 300.

In some embodiments, the processor 206 or an external device 300 includes image analysis software used to detect an unsafe condition. For example, the image analysis software is operable to use image recognition to detect an infant in an image. Then, the image analysis software is operable to compare the detected infant frame-by-frame to detect motion or a lack thereof. Thus, by detecting a lack of motion for a predetermined time, the image analysis software is operable to detect an infant 106 that stops breathing. The particular time thresholds, like with respect to the motion detector 240, may include default times and may be adjusted by a user.

Moreover, the image analysis software is operable to use facial recognition to detect whether the infant 106 is positioned on his or her back (supine position) or stomach (prone position). Medical research has shown that sleeping in the supine position reduces instances of Sudden Infant Death Syndrome (SIDS). Accordingly, the image analysis software is operable to detect an infant 106 positioned in the sleep pod 100 in the prone position and to generate an alert to the user. The alert may suggest that the user position the baby in the supine position, particularly using vocalized instruction via the speaker 252, text instructions via the display 256 of the I/O 204, or with other of the previously described output techniques. Furthermore, the image analysis software is operable to use facial recognition to detect when the infant 106 is awake versus asleep dependent on whether the infant 106 has opened or closed eye lids. In turn, the processor 206 may communicate a change in state of the infant 106 from awake to asleep and vice versa to a user, particularly via external device 300.

In some embodiments, the sensor unit 202 includes a microphone to detect sound from the infant 106. The microphone outputs audio data to the processor 206. Like with the camera output, the audio data may be streamed to external devices 300 and/or stored in memory 208 for later retrieval. Additionally, a remote user via external devices 300 may transmit audio to the sleep pod 100 for output via the speakers 252, providing two-way communication. Audio analysis software of the processor 206 or one of the external devices 300 is operable to detect a state of the infant 106. For instance, the audio analysis software is operable to detect when the infant 106 is awake versus asleep dependent on whether the infant 106 is crying or otherwise vocalizing. As an example, sound detected by the microphone that exceeds a predetermined decibal level for a predetermined amount of time indicates that the infant 106 is awake.

In some embodiments, other sensors are incorporated into the bridge 116 to monitor and provide feedback on the infant 106 within the sleep pod 100. Although the above sensors are described as being incorporated into the bridges 116 of the sleep pod 100, one or more of the sensors of the sensor unit 202 may be positioned elsewhere on the sleep pod 100. For instance, one or more of the sensors may be positioned on or within the rims 134, walls 114 or 136, or sensor unit 210 of the control unit 200 of the sleep pod 100. In some instances, the positioning of one or more of the sensors of the sensor unit 202 depends on the function of the sensor.

For example, in some embodiments, the sensor unit 202 includes a weight sensor to detect when the bed 112 is empty and when the infant 106 is placed therein. For instance, the weight sensor may be positioned within or just below the bed 112 to detect the weight of objects (e.g., the infant 106) on the bed 112. A weight threshold used to detect presence of the infant 106 is set high enough (e.g., at four pounds) such that a toy or other small item is not misconstrued to be the infant 106. The weight threshold may be adjusted (e.g., to ten pounds), particularly as the infant 106 grows, to further prevent false detections. Upon detecting the infant 106 based on the weight sensor, the processor 206 may enter the armed mode automatically. Alternatively, the user may be prevented from arming the sleep pod (e.g., via arm/disarm switch 246) unless the weight sensor indicates that an infant 106 is present in the sleep pod.

Additionally, in some embodiments, the sensor unit 202 includes a motion monitor (e.g., MPU 211, a pressure sensor, etc.) incorporated into the bed 112 to detect deflections causes by breathing of the infant 106. Thus, similar to use of the motion detector 240, the processor 206 is operable to detect if the infant 106 has ceased breathing using the motion monitor of the bed 112.

In some embodiments, other sensors are incorporated into the sleep pod 100 to monitor and provide feedback on the infant 106 within the sleep pod 100. Additionally, different combinations of electronics features may be included in various embodiments of the sleep pod 100. For instance, some embodiments may include a single accelerometer in the bridge 116, while other embodiments may include accelerometers in the bridge 116 and base 111, as well as the IR sensor pair. The particular combinations of electronics features described herein are exemplary, as a particular sleep pod 100 may include various combinations of the electronics features described herein.

In some embodiments, the electronics of the sleep pod 100 serve as a data recorder where sensor data from sensor units 202 and 210 are stored in the memory 208 for later retrieval, particularly in the event of an accident or injury involving the infant 106. The sensor data may be used to determine further details of the accident or injury, such as the cause thereof. The sensor data stored in the memory 208 may be obtained by an external device 300 for review accordingly to communications techniques described above.

Figure 14:
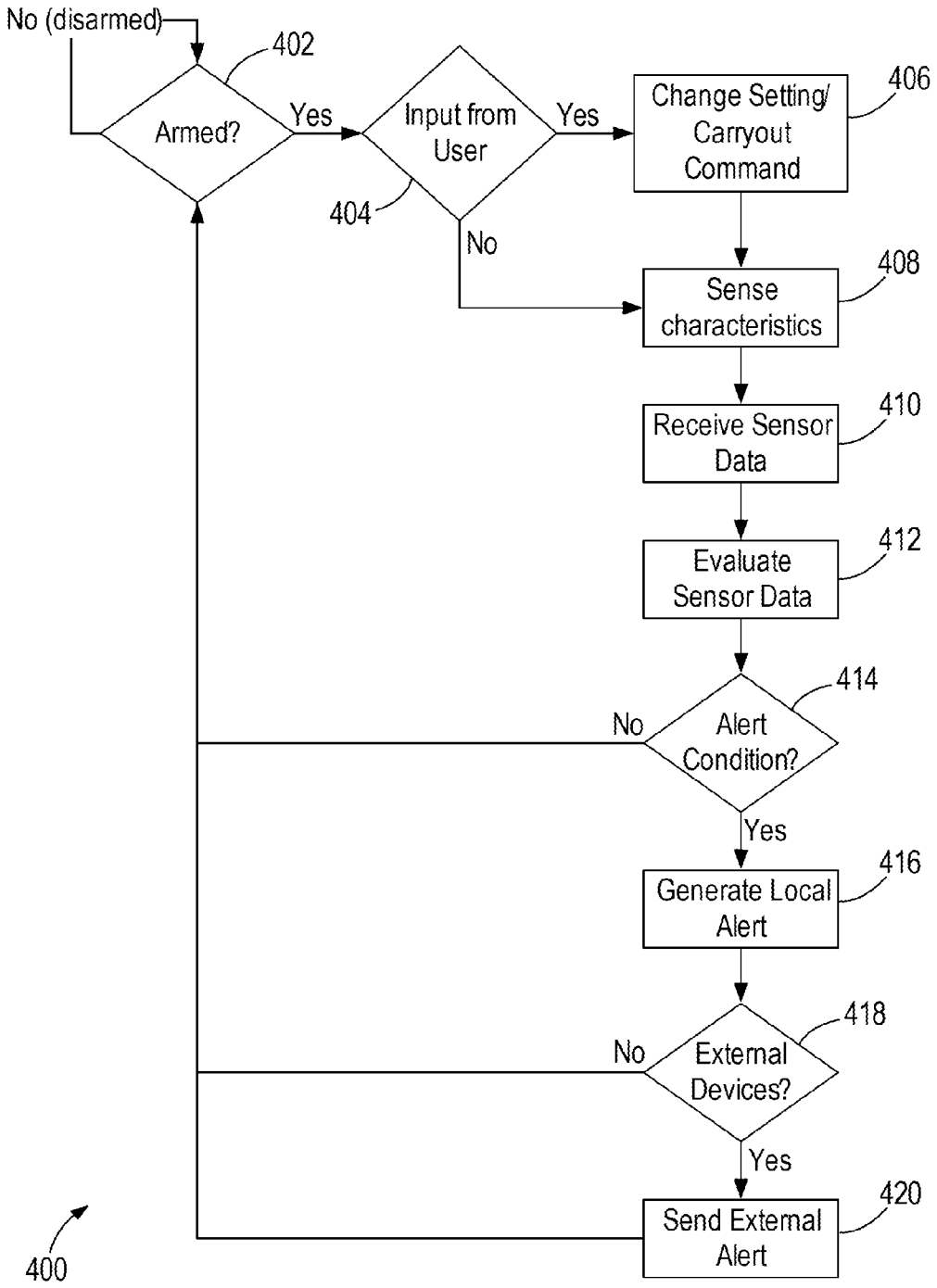
FIG. 14 illustrates a method of monitoring by embodiments of the sleep pod.

FIG. 14 illustrates a method 400 of the sleep pod 100 that is, for instance, carried out by the electronics of FIG. 10. In step 402, control unit 200 determines whether the sleep pod 100 is armed or has received an arming or disarming signal from arm/disarm selector 246 or from an external device 300. If the sleep pod 100 is not armed or has received a disarm signal, the sleep pod 100 is disarmed and repeats step 402 until an arming signal is received. If the sleep pod 100 is armed or has received an arming signal, the sleep pod proceeds to step 404. In step 404, the control unit 200 determines whether a user has input some configuration data (e.g., threshold setting, alert configuration, firmware update, etc.) or otherwise provided a control command to the sleep pod 100, for instance, to activate a light, output a sound, etc. If no user input has been received, the control unit 200 proceeds to step 406. If user input has been received, the control unit 200 carries out the configuration update or command in step 408, and proceeds to step 406.

In step 406, the various sensors of the sleep pod 100 sense characteristics of the sleep pod 100 and/or the infant 106. In step 410, the sensors, such as the sensors of the sensor unit 202 and sensor unit 210, output sensor data, which is received by the processor 206 of the control unit 200. In step 412, the control unit 200 evaluates the sensor data to determine if an alert condition is present. For instance, temperature data from the temperature sensor 236 is compared against predetermined thresholds to determine if a temperature threshold has been exceeded. Additionally, the motion data output by one or both of the motion processing units (MPUs) 234 and 211, and/or the differences between the acceleration data output, are compared against one or more thresholds to determine if an alert condition is present. In step 414, the control unit 200 determines whether an alert condition is present and, if so, proceeds to step 416. If no alert condition is present, the sleep pod returns to step 402.

In step 416, a local alert is generated by the control unit 200. For instance, various lights, sounds, and/or vibrations are generated by the user I/O 204. The lights, sounds, and/or vibrations emitted are dependent on the severity of the alert such that a more severe alert (e.g., an alarm) is more pronounced than a less severe alert (e.g., a warning). For instance, a more severe alert may have louder sounds, brighter lights, different colored lights (e.g., red), more rapidly flashing lights, and/or stronger vibrations than a less severe alert.

In step 418, the control unit 200 determines whether electronic devices are to be alerted. For instance, the control unit 200 determines if it is currently connected to any external devices 300 and, if so, sends the alerts thereto in step 420. Additionally, or alternatively, previous user settings stored in the memory 208 are operable to indicate which external devices 300 to receive alerts and by which communication interfaces (e.g., Bluetooth, WiFi, USB, etc.). After alerts are sent in step 420, the sleep pod returns to step 402.

In some embodiments, the electronics of the sleep pod 100, including the control unit 200, sensor unit 202, and user I/O 204 are portable and may be interchanged among other child-occupied products, such as car seats, cribs, basinets, etc. Such an interchangeable version of the control unit 200 includes customizable software that is operable with the various products. The control unit 200 may detect, or the user may specify, the type, make, and/or model of the product to which it is secured, and adapt accordingly. The control unit 200 may detect the product to which it is secured through an electronic handshake (wireless or wired) with the product, or through an electro-mechanical key feature where each product has a particular mechanical coupling mechanism that the control unit 200 detects upon being attached thereto. The product may include its own sensor unit 202 and user I/O 204, or the sensor unit 202 and user I/O 204 useable with the sleep pod 100 may also be secured to the product. The monitoring software of the control unit 200 is then reconfigured for use with the particular product. For instance, the various thresholds used, alerts generated, and sensors used are dependent on the type of product to which the control unit 200 is attached. For instance, in a car seat implementation, the motion processing units (MPUs) 211 and/or 234 may detect and record g-forces, which may later be obtained by medical professions, insurance companies, etc. in the event of an accident. Additionally, in the car seat implementation, the temperature sensor 236 is usable to detect, for instance, when a child is left in a hot car in the summer—a potentially deadly situation. Upon detection of a temperature exceeding healthy thresholds for the child, the controller 206 is operable to generate an alert, which can include an automated call or message to first responders (fire, police, emergency medical technicians (EMTs)), government authorities, parents, etc.

Thus, the invention provides, among other things, an infant sleep pod having passive and/or active safety features. Various features and advantages of the invention are set forth in the following claims.

What is claimed is:

1. An infant sleep pod comprising:

a base including a sidewall and a bed providing an infant sleep area;

a bridge extending across the bed and having a bridge sensor sensing a characteristic of at least one of the infant sleep pod and an infant in the infant sleep area, wherein the bridge sensor is a bridge motion processing unit configured to detect bridge motion data along multiple axes of direction and an output of the bridge sensor includes bridge motion data; and a control unit in communication with the bridge sensor, the control unit configured to access a plurality of predetermined thresholds stored in memory, generate a first alert indicating an unsafe condition of a first severity level in response to determining that the bridge motion data exceeds a first predetermined threshold of the plurality of predetermined thresholds, and generate a second alert indicating an unsafe condition of a second severity level that is higher than the first severity level in response to determining that the bridge motion data exceeds a second predetermined threshold of the plurality of predetermined thresholds.

2. The infant sleep pod of claim 1, further comprising:

a base motion processing unit in the base and in communication with the control unit and configured to output base motion data to the control unit, wherein the control unit is configured to generate a further alert based on the base motion data and the bridge motion data.

3. The infant sleep pod of claim 1, the bridge further comprising an infrared transmitter and an infrared detector, the control unit generating an alarm condition based on receipt, by the infrared detector, of reflections of infrared transmissions from the infrared transmitter.

4. The infant sleep pod of claim 1, the bridge further comprising at least one selected from a group consisting of a temperature sensor, an infrared sensor, a camera, and a motion sensor.

5. The infant sleep pod of claim 1, further comprising a sensor unit on the bridge, the sensor unit including the bridge sensor and at least one additional sensor that senses a second characteristic of at least one of the infant sleep pod and an infant in the infant sleep area.

6. The infant sleep pod of claim 1, further comprising a user interface on the bridge, the user interface including at least one selected from a group consisting of an alert output device and an arm/disarm selector.

7. The infant sleep pod of claim 1, further comprising communication wire coupled to the bridge sensor and to the control unit, the communication wire positioned within a leg of the bridge and providing a communication path between the bridge sensor and the control unit.

8. The infant sleep pod of claim 1, wherein the control unit is positioned in a recess of the base.

9. The infant sleep pod of claim 1, wherein the control unit further includes a wireless communication module in wireless communication with at least one external device.

10. The infant sleep pod of claim 9, wherein the wireless communication includes at least one selected from a group consisting of the alert output by the control unit, sensor data output from the control unit including data output by the bridge sensor, and a control signal from the at least one external device.

11. A method of monitoring an infant sleep pod having a base including a bed, a bridge extending across the bed and including a bridge sensor, and a control unit in communication with the bridge sensor, the method comprising:

receiving, by the control unit, a signal from the bridge sensor;

evaluating the signal by the control unit;

generating an alert, by the control unit, based on the evaluation, wherein the bridge sensor is a bridge motion processing unit configured to detect bridge motion data along multiple axes of direction and the signal includes bridge motion data;

wherein evaluating the signal includes comparing the bridge motion data to a predetermined threshold, and determining an unsafe condition exists when the bridge motion data exceeds the predetermined threshold; and wherein the alert indicates that the unsafe condition was determined.

12. The method of monitoring of claim 11, wherein the base includes a base motion processing unit, the method further comprising:

generating base motion data from the base motion processing unit;

calculating a difference between the bridge motion data and the base motion level; and generating a further alert when the difference exceeds a difference threshold.

13. The method of monitoring of claim 11, wherein the base includes a base motion processing unit, the method further comprising:

generating base motion data from the base motion processing unit; and generating a further alert when the base motion data exceeds a second predetermined threshold.

14. The method of monitoring of claim 11, wherein the alert is a deformation alert and the unsafe condition is that the bridge is deformed.

15. The method of monitoring of claim 11, wherein the the unsafe condition is at least one selected from a group consisting of a tipped sleep pod, a tipping sleep pod, a falling sleep pod, and a fallen sleep pod.

16. The method of monitoring of claim 11, the bridge further comprises an infrared sensor including an infrared emitter and receiver, the method further comprising:

emitting, by the infrared emitter, an infrared signal away from the bed;

receiving, by the infrared receiver, a reflection of the infrared signal;

providing an indication of the reflection to the control unit;

generating a further alert, by the control unit, in response to the indication, the further alert indicating that the infrared sensor is covered.

17. The method of monitoring an infant of claim 11, further comprising:

receiving, by the control unit, an arming signal;

generating an armed indicator to indicate that the sleep pod is armed.

18. The method of monitoring of claim 11, wherein the alert is wirelessly output to an external device.

19. An infant sleep pod comprising:

a base including a sidewall and a bed providing an infant sleep area;

a bridge extending across the bed and having a bridge sensor sensing a characteristic of the infant sleep pod, wherein the bridge sensor is a bridge motion processing unit and an output of the bridge sensor includes bridge motion data; and a control unit in communication with the bridge sensor, the control unit configured to generate a deformation alert to indicate that the bridge is deformed inward toward the bed based on the bridge motion data.

20. An infant sleep pod comprising:

a base including a sidewall and a bed providing an infant sleep area;

a bridge extending across the bed and having a multi-axis bridge sensor sensing a characteristic of the infant sleep pod, wherein the bridge sensor is a bridge motion processing unit and an output of the bridge sensor includes bridge motion data including at least one selected from a group consisting of multi-axis tilt data and multi-axis acceleration data;

a control unit in communication with the bridge sensor, the control unit configured to generate an alert based on the bridge motion data from the bridge sensor, wherein the alert indicates at least one selected from a group consisting of a tipped sleep pod, a tipping sleep pod, a falling sleep pod, and a fallen sleep pod.

21. A method of monitoring an infant sleep pod having a base including a bed, a bridge extending across the bed and including a bridge sensor, and a control unit in communication with the bridge sensor, the method comprising:

receiving, by the control unit, a signal from the bridge sensor;

evaluating the signal by the control unit;

generating an alert, by the control unit, based on the evaluation, wherein the bridge sensor is a bridge motion processing unit and the signal includes bridge motion data, the method further comprising generating a deformation alert to indicate that the bridge is deformed inward toward the bed based on the bridge motion data.

22. A method of monitoring an infant sleep pod having a base including a bed, a bridge extending across the bed and including a multi-axis bridge sensor, and a control unit in communication with the bridge sensor, the method comprising:

receiving, by the control unit, a signal from the multi-axis bridge sensor, wherein the bridge sensor is a bridge motion processing unit and the signal includes bridge motion data including at least one selected from a group consisting of multi-axis tilt data and multi-axis acceleration data;

evaluating the signal by the control unit by comparing data of the bridge motion data from the multi-axis bridge sensor to a stored predetermined threshold;

generating an alert, by the control unit, based on the evaluation, wherein the alert indicates at least one selected from a group consisting of a tipped sleep pod, a tipping sleep pod, a falling sleep pod, and a fallen sleep pod.

* * * * *